United States Patent [19]

Ikenoue et al.

[11] 4,307,187

[45] Dec. 22, 1981

[54] THERMALLY DEVELOPABLE LIGHT-SENSITIVE MATERIALS

[75] Inventors: Shinpei Ikenoue; Takao Masuda, both of Asaka, Japan

[73] Assignee: Fuji Photo Film Co., Ltd., Minami-ashigara, Japan

[21] Appl. No.: 147,011

[22] Filed: May 6, 1980

Related U.S. Application Data

[63] Continuation of Ser. No. 644,685, Dec. 29, 1975, abandoned.

[30] Foreign Application Priority Data

Dec. 28, 1974 [JP] Japan ..... 50/299

[51] Int. Cl.[3] ..... G03C 1/02

[52] U.S. Cl. ..... 430/619; 430/620; 430/607; 430/353

[58] Field of Search ..... 430/353, 607, 618, 619, 430/620

[56] References Cited

U.S. PATENT DOCUMENTS

| | | | |
|---|---|---|---|
| 2,394,198 | 2/1946 | Mueller | 430/613 |
| 3,047,393 | 7/1962 | Herz et al. | 430/607 |
| 3,457,078 | 7/1969 | Riester | 430/611 |
| 3,645,739 | 2/1972 | Ohkubo et al. | 430/618 |
| 3,801,321 | 4/1974 | Evans et al. | 430/353 |
| 3,819,379 | 6/1974 | Ohyama et al. | 430/505 |
| 3,839,041 | 10/1974 | Hiller | 430/965 |
| 4,213,784 | 7/1980 | Ikenoue et al. | 430/353 |

*Primary Examiner*—J. Travis Brown

*Attorney, Agent, or Firm*—Sughrue, Mion, Zinn, Macpeak and Seas

[57] ABSTRACT

A thermally developable light-sensitive material comprising a support having provided therein or thereon at least one layer containing at least (a) an organic silver salt, (b) light-sensitive silver halide or a component capable of forming a light-sensitive silver halide, and (c) a reducing agent, the support further having provided therein or thereon at least one layer containing (d) at least one thiosulfonic acid. In a highly preferred embodiment, (e) one or more benzotriazoles are also present.

31 Claims, No Drawings

THERMALLY DEVELOPABLE LIGHT-SENSITIVE MATERIALS

This is a continuation of application Ser. No. 644,685, filed Dec. 29, 1975, abandoned.

BACKGROUND OF THE INVENTION

1. Field of the Invention

The present invention relates to thermally developable light-sensitive materials, more particularly, to improved thermally developable light-sensitive materials which comprise thiosulfonic acids therein, whereby generation of heat fog (photographic fog caused in non-exposed areas upon heat development of thermally developable light-sensitive materials, which must be prevented in order to improve the photographic properties of the thermally developable light-sensitive materials) is reduced and freshness retention (the property of maintaining, during storage, photographic properties such as sensitivity and heat fog-preventing properties at the levels immediately after production thereof) is improved.

2. Description of the Prior Art

Various processes are known for preventing heat fogging of thermally developable light-sensitive materials. One comprises using a mercury compound as described in Japanese Patent Publication 11,113/72. However, as is well known, mercury compounds are so toxic that the use thereof in great amounts entails serious dangers. Another process for preventing heat fogging comprises using N-halogeno compounds such as N-halogenosuccinimide, N-halogenoacetamide, etc., as is described in Japanese Patent Publications (OPI) No. 10,724/74, 97,613/74 and 90,118/74. Furthermore, acid stabilizers are known such as higher fatty acids (e.g., lauric acid, myristic acid, palmitic acid, stearic acid, behenic acid, etc.) as described in U.S. Pat. No. 3,645,739 and Japanese Patent (OPI) 89,720/73, salicylic acid, p-hydroxybenzoic acid, tetrabromobenzoic acid, tetrachlorobenzoic acid, p-acetamidobenzoic acid, aikyl-substituted benzoic acid (e.g., p-t-butyl benzoic acid, etc.), phthalic acid, isophthalic acid, trimellitic acid, pyromellitic acid, diphenic acid, 5', 5'-methylenebissalicylic acid, and the like. However, these N-halogeno compounds and acid stabilizers do not show marked effects though they possess some heat fog-preventing effect, and therefore, they are commercially unsatisfactory. Furthermore, when used in large amounts, some of these compounds show side effects such as a reduction of sensitivity, deterioration of light stability and a reduction in image density. These compounds are thus of marginal commercial acceptability as well.

At present, the most successful light-sensitive elements capable of forming a photographic image by dry processing are the heat developable light-sensitive elements employing a composition comprising a silver salt of an organic acid, a small amount of a light-sensitive silver halide and a reducing agent, e.g., as described in U.S. Pat. Nos. 3,152,904 and 3,457,075. In such light-sensitive systems, the silver halide which remains in the element after development is not stabilized against light and is allowed to be discolored by light. Nevertheless, the element provides results as if it were stabilized, because the silver halide is only used in a slight amount and most of the silver source is a white or light-colored organic silver salt which is stable and hardly blackened by light. Thus, even if a small amount of silver halide is discolored by light, the slight discoloring does not give rise to any visual difficulties since the element, on the whole, still appears white or only slightly colored. The light-sensitive element is stable at normal temperature, but when it is image-wise exposed and heated, usually above about 80° C., preferably above 100° C., the organic silver salt oxidizing agent and the reducing agent which are present in the light-sensitive element undergo an oxidation-reduction reaction due to the catalytic action of the exposed silver halide present in the vicinity thereof to form silver. By this reaction, the exposed areas of the light-sensitive layer are rapidly blackened so that contrast is formed between the exposed areas and the unexposed areas (background) that is, an image is formed.

SUMMARY OF THE INVENTION

Therefore, it is one object of the present invention to provide a thermally developable light-sensitive material which undergoes no reduction in sensitivity upon being stored under the condition of high temperature and high humidity.

Another object of the present invention is to provide a thermally developable light-sensitive material suffering less heat fog during storage under conditions of high temperature and high humidity.

A further object of the present invention is to provide a thermally developable light-sensitive material suffering less change in tone even when stored under conditions of high temperature and high humidity.

Still a further object of the present invention is to provide a thermally developable light-sensitive material of low toxicity .

As a result of intensive research to solve the above-described problems with the prior art, the inventors reached the present invention.

The present invention provides a thermally developable light-sensitive material which comprises a support having provided therein or thereon at least one layer containing at least (a) an organic silver salt, (b) light-sensitive silver halide or a component capable of forming light-sensitive silver halide and (c) a reducing agent, said support further having provided therein or thereon (d) at least one layer containing at least one thiosulfonic acid and, optionally, at least one benzotriazole.

The present invention thus provides improved thermally developable light-sensitive materials as described above, which exhibit reduced heat fog and improved freshness retention by using a particular stabilizer.

DETAILED DESCRIPTION OF PREFERRED EMBODIMENTS

The organic silver salt, ingredient (a), light-sensitive silver halide or component capable of forming a light-sensitive silver halide, ingredient (b), and reducing agent, component (c), are conventional in the thermally developable light-sensitive material art.

The organic silver salt ingredient (a) in the present invention is a colorless or slightly colored silver salt comparatively stable against light, which reacts with a reducing agent to form a silver image when heated to not less than about 80° C., preferably not less than 100° C., in the presence of exposed silver halide. Such organic silver salts include silver salts of organic compounds having an imino group, a mercapto group, a thione group or a carboxy group. Specific examples thereof are as follows.

(1) Silver salts of organic compounds having an imino group: silver salt of benzotriazole, silver salt of nitrobenzotriazole, silver salt of an alkyl-substituted benzotriazole (e.g.,) methylbenzotriazole, etc.), silver salt of a halogen-substituted benzotriazole (e.g., silver salt of bromobenzotriazole, silver salt of chlorobenzotriazole, etc.), silver salt of a carboimido-substituted benzotriazole

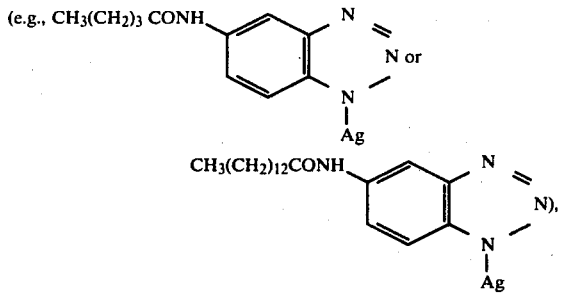

silver salt of benzimidazole, silver salt of a substituted benzimidazole (e.g., silver salt of 5-chlorobenzimidazole, silver salt of 5-nitrobenzimidazole, etc), silver salt of carbazole, silver salt of saccharin, silver salt of phthalazinone, silver salt of a substituted phthalazinone, silver salts of phthalimides, silver salt of pyrrolidone, silver salt of tetrazole, silver salt of imidazole, etc.

(2) Silver salts of compounds having a mercapto group or thione group: silver salt of 3-mercapto-4-phenyl-1,2,4-triazole, silver salt of 2-mercapto-benzimidazole, silver salt of 2-mercapto-5-aminothiadiazole, silver salt of 1-phenyl-5-mercapto-tetrazole, silver salt of 2-mercapto-benzothiazole, silver salt of 2-(S-ethylthioglycolamido)benzothiazole, silver salt of thioglycolic acid (e.g., silver salt of S-alkyl (having 12–22 carbon atoms)-thioglycolic acid as described in Japanese Patent Publication (OPI) 28,221/73), silver salt of dithiocarboxylic acid (e.g., silver dithioacetate, etc.), silver salt of thioamide, silver salt of thiopyridine (e.g., silver salt of 5-carbethoxy-1-methyl-2-phenyl-4-thiopyridine, etc.), silver salt of dithiodihydroxybenzole, silver salt of mercaptotriazine, silver salt of 2-mercaptobenzoxazole, silver salt of mercaptoxadiazole, etc.

(3) Silver salts of organic compounds having a carboxy group:

(i) silver salts of aliphatic carboxylic acids; silver caprate, silver laurate, silver myristate, silver palmitate, silver stearate, silver behenate, silver maleate, silver fumarate, silver tartrate, silver furoate, silver linoleate, silver oleate, silver hydroxystearate, silver adipate, silver sebacate, silver succinate, silver acetate, silver butyrate, silver camphorate, etc.

(ii) silver salts of aromatic carboxylic acids, and the like; silver benzoate, silver salt of a substituted benzoic acid (e.g., silver 3,5-dihydroxy benzoate, silver o-methylbenzoate, silver m-methylbenzoate, silver p-methylbenzoate, silver 2,4-dichlorobenzoate, silver acetamidobenzoate, silver p-phenylbenzoate, etc.), silver gallate, silver tannate, silver phthalate, silver terephthalate, silver salicylate, silver phenylacetate, silver pyromellitate, silver salt of 4'-n-octadecyloxydiphenyl-4-carboxylic acid, silver salt of thionecarboxylic acid as described in, e.g., U.S. Pat. No. 3,785,830, silver salt of an aliphatic carboxylic acid having a thioether group as described in, e.g., U.S. Pat. No. 3,330,663, etc.

(4) Silver salts of other compounds: silver salt of 4-hydroxy-6-methyl-1,3,3a,7-tetrazaindene, silver salt of 5-methyl-7-hydroxy-1,2,3,4,6-pentazaindene, silver salt of tetrazaindene as described in British Patent 1,230,642, silver salt of S-2-aminophenylthiosulfuric acid, metal-containing aminoalcohols as described in British Pat. No. 1,346,595, organic acid metal chelates as described in U.S. Pat. No. 3,794,496, etc.

If desired, these organic silver salts can be used in combination with oxidizing agents other than silver salts such as titanium oxide, zinc oxide, a gold carboxylate (e.g., gold laurate, gold stearate, gold behenate, etc.), or the like.

Silver salts of straight chain monocarboxylic acids having 10 or more carbon atoms such as silver laurate, silver myristate, silver palmitate, silver stearate, silver behenate, etc., are particularly preferred in the present invention since they serve to provide high sensitivity with low heat fog.

Such organic silver salts can be prepared according to various processes. The simplest process is to prepare organic silver salts by mixing a solution prepared by dissolving an organic silver salt-forming agent or a salt thereof in a water-miscible solvent (e.g., alcohol or acetone) or water, with an aqueous solution of a water-soluble silver salt (e.g., silver nitrate) as described in U.S. Pat. No. 3,457,075.

Furthermore, it is also possible to mix a colloidal dispersion of an ammonium or alkali metal salt of an organic silver salt-forming agent with an aqueous solution of a water-soluble silver salt (e.g., silver nitrate) as is described in British Pat. No. 1,347,350.

In a similar process, it is also possible to use an aqueous solution of a silver complex salt (such as a silver ammine complex salt or a solution prepared by dissolving such a silver complex salt in a water-miscible solvent in place of the aqueous solution of a water-soluble silver salt such as silver nitrate.

As other processes, U.S. Pat. No. 3,458,544 discloses mixing an oil-soluble solution which is substantially insoluble in water (such as a benzene solution) containing dissolved therein an organic carboxylic acid with an aqueous solution of a silver complex salt to prepare a silver salt of an organic carboxylic acid. Preferably, water is added to the oil-soluble solution to prepare an emulsion before mixing with the aqueous solution of the silver complex salt. Similar processing can be applied to other organic silver salts.

Japanese Patent Publication No. 30,270/69 describes a similar process which, however, provides organic silver salts more stable against heat and light which comprises using a solution of an alkali-free silver compound, such as an aqueous solution of silver nitrate, in place of a silver complex salt. According to this process, silver salt of benzotriazole can be obtained in high yield.

In addition, Japanese Patent Application Ser. No. 9,362/73 describes a process for preparing organic silver salts. This process is preferred because a thermally developable light-sensitive material using an organic silver salt obtained according to this process suffers less heat fog. According to this process, organic silver salts are prepared by mixing an emulsion of an aqueous solution of an alkali metal salt or ammonium salt of a water-soluble organic silver salt-forming agent and an oil (e.g., benzene, toluene, cyclohexane, pentane, hexane, a carboxylic acid ester such as an acetate, phosphate, (castor oil, etc.) with a silver salt (silver nitrate, etc.) or a silver complex salt, preferably as an aqueous solution. As an alternative thereof, organic silver salts can be prepared by mixing an aqueous alkali solution with an oil-soluble solution (for example, a toluene solution) of an organic silver salt-forming agent and emulsifying the same, and thereafter mixing the resulting emulsion with a highly soluble silver salt such as silver nitrate or a silver complex salt such as a silver ammine complex salt, preferably as an aqueous solution. As the oil used for the preparation of the aforesaid oily solutions, the following are generally used: (1) phosphates: tricresyl phosphate, tributyl phosphate, monooctyldibutyl phosphate, etc.; (2) phthalic esters: diethyl phthalate, dibutyl phthalate, dimethyl phthalate, dioctyl phthalate, dimethoxyethyl phthalate, etc.; (3) carboxylic esters: acetic esters such as amyl acetate, isopropyl acetate, isoamyl acetate, ethyl acetate, 2-ethylbutyl acetate, butyl acetate, propyl acetate, etc., sebacic esters such as dibutyl sebacate, diethyl sebacate, etc., succinic esters such as diethyl succinate, etc., formic esters such as ethyl formate, propyl formate, butyl formate, amyl formate, etc., valeric esters such as ethyl valerate, etc., tartaric esters such as diethyl tartrate, etc., butyric esters such as methyl butyrate, ethyl butyrate, butyl butyrate, isoamyl butyrate, etc., adipic esters, etc.; (4) oils such as castor oil, cotton seed oil, linseed oil, tsubaki oil, etc; (5) aromatic hydrocarbons such as benzene, toluene, xylene, etc.; (6) aliphatic hydrocarbons such as pentene, hexane, heptane, etc.; and (7) cyclic hydrocarbons such as cyclohexane, etc.

As the silver complex salt, there are preferably used alkali-soluble silver complex salts having a dissociation constant higher than that of the organic silver salts, such as a silver ammine complex salt, a silver methylamine complex salt, a silver ethylamine complex salt, etc.

As the solvents for silver salts such as silver nitrate, there can be used polar solvents such as dimethylsulfoxide, dimethylformamide, acetonitrile, etc., in addition to water.

Also, as is described in Japanese Patent Application Ser. No. 7,619/73, it is possible to apply ultrasonic waves during the preparation of organic silver salts. In particular, application of ultrasonic waves upon emulsification of water and oil facilitates the emulsification. It is also possible to add a surface active agent during preparation of organic silver salts for the purpose of adjusting the grain size of the organic silver salts. Furthermore, organic silver salts may be prepared in the presence of a polymer. As a special process, it is known to mix a non-aqueous solution of an organic carboxylic acid with a non-aqueous solution of a heavy metal salt, e.g., a trifluoroacetate or tetrafluoroborate, in the presence of a polymer to thereby prepare a heavy metal salt such as a silver salt of an organic carboxylic acid, as is described in U.S. Pat. No. 3,700,458. U.S. Pat. No. 3,748,143 also describes a process for preparing an emulsion using a similar non-aqueous solution.

As is described in Japanese Patent Applications Ser. Nos. 49,436/72 and 43,867/72 and in West German Patent OLS 2,322,096, the grain shape and grain size of organic silver salts, and the photographic properties thereof such as heat fog, light stability, sensitivity, and the like, can be changed by the presence of a metal salt such as a mercury or lead compound or a metal complex during the preparation of organic silver salts. As the metal, cobalt, manganese, nickel and iron have been confirmed to be effective in addition to the above-described mercury and lead. These metal-containing compounds may be used by mixing a mixed solution or dispersion of a solution of a silver salt-forming organic compound and the metal-containing compound with an aqueous solution of a highly soluble silver salt such as silver nitrate or a silver complex salt such as a silver ammine complex salt with each other. Further, three components, i.e., a solution or dispersion of the metal-containing compound, an aqueous solution of a silver salt or a silver complex salt and a solution or dispersion of a silver salt-forming organic compound may be mixed with each other. Still further, mixing a solution or dispersion of a silver salt-forming organic compound with a mixed solution or dispersion of the silver salt or silver complex salt and the metal-containing compound is also preferred. The content of the metal-containing compound is preferably from about $10^{-6}$ to about $10^{-1}$ mol per 1 mol of the organic silver salt and from about $10^{-5}$ mol to about $10^{-2}$ mol per 1 mol of silver halide.

The thus prepared organic silver salt grains are from about 10μ to about 0.01μ, preferably from about 5μ to about 0.1μ, in length.

The light-sensitive silver halide used as ingredient (b) in the present invention can be silver chloride, silver bromide, silver iodide, silver chlorobromoiodide, silver chlorobromide, silver chloroiodide, silver bromoiodide or a mixture thereof. The amount thereof used ranges from about 0.001 mol to about 0.5 mol, preferably from about 0.01 mol to about 0.3 mol, per 1 mol of the organic silver salt. The light-sensitive silver halide may be coarse grain or fine grain, but the latter is preferred. A preferred grain size (length) of the silver halide ranges from about 1μ to about 0.001μ, preferably from about 0.5μ to about 0.01μ.

A light-sensitive silver halide per se can be prepared according to conventional processes known in the photographic field, such as a single jet process, double jet process, etc. For example, there can be used a Lippmann emulsion, an ammoniacal emulsion, a thiocyanate- or thioether-ripened emulsion, etc. Silver halide emulsions which are not washed or which have been washed with water, alcohol or the like to remove soluble salts may be used in the present invention. A light-sensitive silver halide thus previously prepared is mixed with an oxidation-reduction composition comprising an organic silver salt component (a), and a reducing agent, component (c), as described in U.S. Pat. No. 3,152,904.

However, it is clear that a "pre-prepared" silver halide obtained according to the process described in U.S. Pat. No. 3,152,904 often does not provide satisfactory light sensitivity due to insufficient contact between the silver halide and the organic silver salt, as described in U.S. Pat. No. 3,457,075. Therefore, various techniques have been developed to effect sufficient contact between the silver halide and organic silver salt. One technique comprises adding a surface active agent to a coating solution which is to form a light-sensitive layer, examples of which are described in Japanese Patent Applications Nos. 82,852/73 and 82,851/73. Another technique comprises mixing the prepared silver halide with the organic silver salt in a polymer, examples of which are described in U.S. Pat. Nos. 3,705,565, 3,713,833, 3,706,564 and 3,761,273, British Pat. No. 1,354,186, French Pat. No. 2,078,586 and Belgian Pat. No. 774,436, etc.

The silver halide used in the present invention may be prepared substantially simultaneously with the formation of the organic silver salt as described in Japanese Patent Application Ser. No. 65,727/73, if desired. As a specific example, a solution of a silver salt such as silver nitrate or a silver complex salt is mixed with a solution or dispersion of the aforesaid organic silver salt-forming compound or a salt thereof containing a light-sensitive silver halide-forming ingredient (to be described hereinafter), or a solution of a light-sensitive silver halide-forming agent is simultaneously mixed upon mixing a solution or dispersion of an organic silver salt-forming compound or a salt thereof with a solution of a silver salt such as silver nitrate and a silver complex salt, to thereby form light-sensitive silver halide simultaneously with the organic silver salt. It is possible to react a light-sensitive silver halide-forming ingredient (to be described hereinafter) with a previously prepared organic silver salt solution or dispersion, or to react the same on a sheet material containing an organic silver salt to thereby form light-sensitive silver halide in part of the organic silver salt. U.S. Pat. 3,457,075 describes that the thus formed silver halide is in effective contact with the organic silver salt and gives good results.

On the other hand, an ingredient capable of forming a light-sensitive silver halide is a compound capable of forming silver halide by acting on the organic silver salt. Such can be determined by a simple test as follows to see which compounds are effective. That is, the silver halide-forming ingredient is reacted with the organic silver salt and, if desired, after heating, it is examined by X-ray diffraction analysis to determine whether the diffraction peak characteristic of silver halide exists or not. If the diffraction peak exists, the compound can be used.

As specific examples of ingredients capable of forming a light-sensitive silver halide there are illustrated the following compounds.

(1) Inorganic halides: halides represented by, e.g., $MX_n$ (wherein M represents H, $NH_4$ or a metal atom, X represents Cl, Br or I, and n represents 1 when M is H or $NH_4$, or, when M is a metal atom, n represents the valence of the metal, where examples of the metal atom include lithium, sodium, potassium, rubidium, cesium, copper, gold, beryllium, magnesium, calcium, strontium, barium, zinc, cadmium, mercury, aluminum, gallium, indium, lanthanum, ruthenium, thallium, germanium, tin, lead, antimony, bismuth, chromium, molybdenum, tungsten, manganese, rhenium, iron, cobalt, nickel, ruthenium, rhodium, palladium, osmium, iridium, platinum, etc.)

(2) Halogen-containing metal complexes: for example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RbCl_6$, $(NH_4)_3RhBr_6$, etc.

(3) Onium halides: quaternary ammonium halides (e.g., trimethylphenylammonium bromide, cetylethyldimethylammonium bromide, trimethylbenzylammonium bromide, etc.), quaternary phosphonium halides (e.g., tetraethylphosphonium bromide, etc.), tertiary sulfonium halides (e.g., trimethylsulfonium iodide, etc.), etc., can be added to a coating dispersion just prior to coating (for example, a coating dispersion for a light-sensitive layer, a protective layer, an undercoating layer or a back coating layer) for the purpose of reducing sensitivity, and, in some cases, background density, as is described in U.S. Pat. No. 3,679,422. Also, as is described in Japanese Patent Publication (OPI) No. 84,443/74, a conductive high molecular weight polymer of the onium salt halide series can be used to prepare a thermally developable light-sensitive and electrosensitive material.

(4) Halogenated hydrocarbons: iodoform, bromoform, carbon tetrabromide, 2-bromo-2-methylpropane, etc.

(5) N-halogenated compounds: compounds represented by the following general formulae:

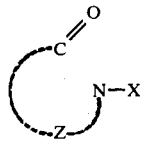

(I)

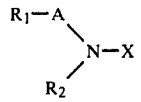

(II)

In these general formulae (I) and (II), X is a halogen atom, preferably a chlorine, bromine or iodine atom. Z represents an atomic group necessary for forming a 5-membered ring or 6-membered ring which can be condensed with another ring. Examples of suitable 5-membered rings and 6-membered rings are pyrrole, pyrroline, pyrrolidine, imidazole, imidazoline, imidazolidine, pyrazole, pyrazoline, pyrazolidine, triazole, tetrazole, piperidine, oxazine, thiazine, piperazine (these previously described rings can contain an oxo group or a thiooxo group, and also can include rings where aromatic rings are combined with the above ring through a phenylene group, etc.), hydantoin, cyanuric acid, thiohydantoin, hexahydrotriazine, indole, indoline, isoindole, benzoimidazole, carbazole and phenoxazine rings. A particularly preferred ring is a pyrrolidine ring. These rings can also be substituted with alkyl groups, aryl groups, alkoxy groups, halogen atoms, oxygen atoms and sulfur atoms. Suitable alkyl groups are those having 1 to about 12 carbon atoms, preferably 1 to 8 carbon atoms, for example, methyl, ethyl, propyl, isopropyl, butyl, isobutyl, t-butyl, pentyl, hexyl, 2-ethylhexyl, octyl, nonyl, decyl and dodecyl groups. Suitable aryl groups are preferably a phenyl group and a naphthyl group, which can be substituted with one or more or alkyl groups having 1 to 4 carbon atoms, such as methyl, ethyl, propyl, isopropyl, butyl and t-butyl groups, and halogen atoms such as chlorine, bromine and iodine. Suitable alkoxy groups are preferably those having 1 to about 12 carbon atoms, more particularly 1 to 8 carbon atoms, such as methoxy, ethoxy, propoxy, isopropoxy, butoxy, t-butoxy, pentoxy, hexoxy, octoxy and dodecoxy groups. A represents a carbonyl group or a sulfonyl group. $R_1$ and $R_2$ each represents an alkyl group, an aryl group or an alkoxy group, the alkyl group and the alkoxy group being preferably those having 1 to about 12 carbon atoms, more preferably 1 to 8 carbon atoms, and the aryl group being preferably a naphthyl group or a phenyl group, which can be substituted with one or more of the above described groups. $R_2$ can also represent a hydrogen atom. The halogenated melamines are N-halo compounds also suitable for the present invention.

Typical examples of N-halo compounds suitable for the invention are as follows:

(1) N-Bromosuccinimide
(2) N-Bromotetrafluorosuccinimide
(3) N-Bromophthalimide
(4) N-Bromoglutarimide (5) 1-Bromo-3,5,5'-trimethyl-2,4-imidazolidinedione
(6) 1,3-Dibromo-5,5-dimethyl-2,4-imidazolidinedione
(7) N,N'-Dibromo-5,5-diethylbarbituric acid
(8) N,N'-Dibromobarbituric acid
(9) N-Bromoisocyanuric acid
(10) N-Bromoacetamide
(11) N-Bromochloroacetamide
(12) N-Bromotrifluoroacetamide
(13) N-Bromoacetanilide
(14) N-Bromobenzenesulfonylanilide
(15) N-Bromobenzamide
(16) N-Bromobenzenesulfonylamide
(17) N-Bromo-N-Benzenesulfonylbenzenesulfonylamide
(18) N-Bromophthalazone
(19) N-Chlorosuccinimide
(20) N-Iodosuccinimide
(21) Trichloroisocyanuric acid
(22) N-Chlorophthalimide
(23) 1,3-Dichloro-5,5-dimethyl-2,4-imidazolidinedione
(24) 3-Chloro-5,5-dimethyl-2,4-imidazolidinedione
(25) 1,3-Diiodo-5,5-dimethyl-2,4-imidazolidinedione
(26) Trichloromelamine
(27) Tribromomelamine
(28) N-Bromocyclohexanedicarbonimide
(29) 1-Bromo-3,5,5-triethyl-2,4-imidazolidinedione
(30) 1-Bromo-3-ethyl-5,5-dimethyl-2,4-imidazolidinedione
(31) 1,3-Dibromo-5,5-diethyl-2,4-imidazolidinedione
(32) N,N-Dibromo-5,5-dimethylbarbituric acid
(33) N,N-Dibromo-5-ethyl-5-methylbarbituric acid
(34) N,N-Dibromo-5-ethyl-5-phenylbarbituric acid
(35) N,N'-Dibromoisocyanuric acid
(36) N-Bromoacetamide
(37) N-Bromonaphthamide
(38) N-Bromohydroxybenzamide
(39) N-Bromocarboxybenzamide
(40) N-Bromotoluenesulfonamide
(41) N-Bromo-N-toluenesulfonyltoluenesulfonylamide
(42) 1-Bromo-3,3,5-trimethyl-2,4-imidazolidinedithione
(43) 1-Bromo-3,5,5-triethyl-2,4-imidazolidinedithione
(44) 1-Bromo-3-ethyl-5,5-dimethyl-2,4-imidazolidinedithione
(45) 1,3-Dibromo-5,5-dimethyl-2,4-imidazolidinedithione
(46) 1,3-Dibromo-5,5-diethyl-2,4-imidazolidinedithione
(47) 1,3-Dichloro-5,5-dimethyl-2,4-imidazolidinedithione
(48) 3-Chloro-5,5-dimethyl-2,4-imidazolidinedithione
(49) 1,3-Diiodo-5,5-dimethyl-2,4-imidazolidinedithione
(50) N-Bromosaccharin
(51) N,N-Dibromo-5,5-dimethyl-2,4,6-pyrimidinetrione
(52) N,N-Dibromo-2,4,5-trioxypyrimidine Such materials are described in Japanese Patent Applications Ser. Nos. 126,658/73, 19,760/74, etc.. In addition, N-halogenated compounds of benzotriazole, benzotriazole substituted by an alkyl group, a nitro group, a halogen atom, an imido group, an amino group or the like are effective . N-halogenated compounds of benzimidazoles can also be used, for example, N-bromo-benzimidazole and N-chloro-benzimidazole.

(6) Other halogen-containing compounds: triphenylmethyl chloride, triphenylmethyl bromide, 2-bromobutyric acid, 2-bromoethanol, dichlorobenzophenone, etc.

Using pre-prepared silver halides or using the mixing method wherein an organic silver salt is mixed with a silver halide-forming reactant, improvements in photographic properties such as n enhancement of sensitivity and a reduction of heat fog can be attained by storage for a suitable period of time (for example, 20 minutes —48 hours) at a room temperature or at elevated temperature (30° C.–80° C.) after the addition of the silver halide-forming agent in the presence of, if desired, a sulfur-containing compound (e.g., a thiosulfate, etc.), a metal (e.g., gold, chromium, tin, lithium, palladium, etc.), a reducing agent or a combination of these compounds.

These silver halide-forming agents may be used alone or in combination. The amount thereof used ranges from about 0.001 mol to about 0.5 mol, preferably from about 0.01 mol to about 0.3 mol, per 1 mol of the organic silver salt. When the amount is less than the lower limit, low sensitivity often results, while when the amount is more than the upper limit, discoloration often increase upon exposure to light (unfavorable coloration in background areas caused when a processed light-sensitive material is left under room light).

It is extremely preferred to apply the method for forming a silver halide by heating an N-halogeno compound in the presence of the organic silver salt in combination with the use of component of ingredient (d) of the present invention as heat fog is extremely remarkably reduced and freshness retention is improved.

Silver halide produced in situ or pre-formed can be chemically sensitized using a chemical sensitizer such as a compound of sulfur, selenium, tellurium, gold, platinum, palladium, etc., a reducing agent such as a tin halide or a combination thereof. Descriptions relating to this art are given in, e.g., U.S. Pat. Nos. 1,623,499, 2,399,083, and 3,297,447.

The light-sensitive silver halide emulsions used in the present invention preferably have added thereto an anti-fogging stabilizing agent such as a triazolium salt, an azaindene, a mercury salt, urazol, sulfocatechol, an oxime, nitron, nitroindazole, or the like, in order to stabilize them against fogging. Descriptions relevant to this art are given in, e.g., U.S. Pat. Nos. 2,728,663, 2,839,405, 2,566,263, 2,597,915, British Pat. No. 623,448, etc.

Some optical sensitizing dyes which are effective for gelatino-silver halide emulsions also show a sensitizing action for the thermally developable light-sensitive material of the present invention. As effective optical sensitizing dyes, there can be illustrated cyanines, merocyanines, complex (tri- or tetranuclear) cyanines, holopolar cyanines, styryls, hemicyanines, oxonols, hemioxonols, etc. Of the cyanine dyes, those which possess a basic nucleus such as a triazoline nucleus, an oxazoline nucleus, a pyrroline nucleus, a pyridine nucleus, an oxazole nucleus, a thiazole nucleus, a selenazole nucleus, an imidazole nucleus, etc., are preferred. Such nuclei may be substituted with an alkyl group, an alkylene group, a hydroxyalkyl group, a sulfoalkyl group, a carboxyalkyl group, an aminoalkyl group or an enamine group capable of forming a fused carbon ring or a heterocyclic ring. As to the chemical structure thereof, symmetrical and unsymmetrical dyes can be used. Also, those which possess an alkyl group, a phenyl group, an enamine group, or a hetero substituent on the methine chain or polymethine chain thereof may be used. In particular, cyanine dyes having a carboxy group are effective for sensitization. Merocyanine dyes may possess an acidic nucleus such as a thiohydantoin nucleus, a rhodanine nucleus, an oxazolidinedione nucleus, a thiozolidinedione nucleus, a barbituric acid nucleus, a thiazolinone nucleus, a malononitrile nucleus, a pyrazolone nucleus, etc., in addition to the above-described basic nuclei. These acidic nuclei may further be substituted by an alkyl group, an alkylene group, a phenyl group, a carboxyalkyl group, a sulfoalkyl group, a hydroxyalkyl group, an alkoxyalkyl group, an alkylamine group or a heterocyclic nucleus. In particular, merocyanine dyes having an imino group or a carboxy group are effective.

If desired, these dyes may be used as various combinations thereof. Furthermore, supersensitizing additives which do not absorb visible light such as ascorbic acid derivatives, azaindenes, cadmium salts, organic sulfonic acids, etc., as described in, e.g., U.S. Pat. Nos. 2,933,390, 2,937,089, etc., may be used in combination therewith. As particularly effective sensitizing dyes for the thermally developable light-sensitive materials of the present invention, there can be illustrated merocyanine dyes having a rhodanine nucleus, a thiohydantoin nucleus or a 2-thio-2,4-oxazolidinedione nucleus, such as 3-p-carboxyphenyl-5-[β-ethyl-2-(3-benzoxazolylidene)ethylidene]-rhodanine, 5-[(3-β-carboxyethyl-2-(3-thiazolinylidene)ethylidene-3-ethylrhodanine, 3-carboxymethyl-5-[(3-methylthiazolinylidene)-α-ethylethylidene]rhodanine, 1-carboxymethyl-5-[(3-ethyl-2-(3H)-benzoxazolylidene)ethylidene]-3-phenyl-2-thiohydantoin, 5-[(3-ethyl-2-benzoxazolynidene)-1-methylethylidene]-3-[(3-pyrrolin-1-yl)-propyl]rhodanine, 3-ethyl-5-[(3-ethyl-2(3H)-benzothiazolylidene)-isopropylidene]-2-thio-2,4-oxazolidinedione, etc., as described in U.S. Pat. No. 3,761,279. In addition, trinuclear merocyanine dyes as described in U.S. Pat. No. 3,719,495, polycyclic aromatic dyes as described in Belgian Pat. No. 788,695, sensitizing dyes mainly for silver iodide as described in Japanese Patent Publication (OPI) No. 17,719/74, styrylquinoline dyes as described in Japanese Patent Publication (OPI) No. 84,637/74, rhodacyanine dyes as described in West German OLS 2,405,713, acidic dyes (e.g., 2', 7'-dichlorofluorescein dye) as described in West German Pat. OLS Nos. 2,401,982, 2,404,591 and in Japanese Patent Applications Ser. Nos. 50,903/73 and 81,550/73, merocyanine dyes as described in Japanese Patent Applications Ser. Nos. 9,565,74, 10,815/74 and 63,732/74, and the like may similarly be used. Specific examples of effective merocyanine dyes having a pyrazolone nucleus are as follows.

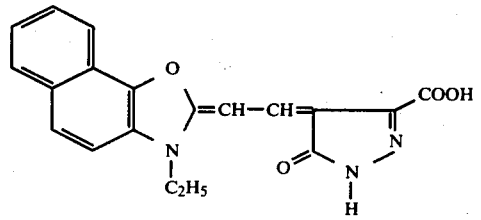

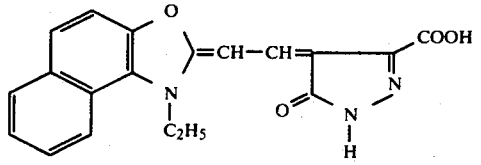

-continued

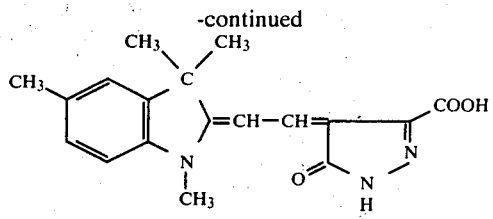

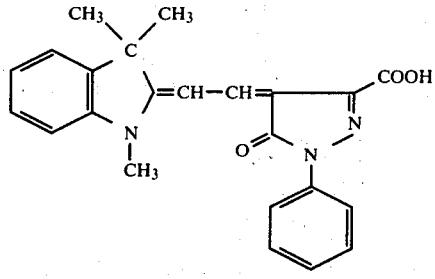

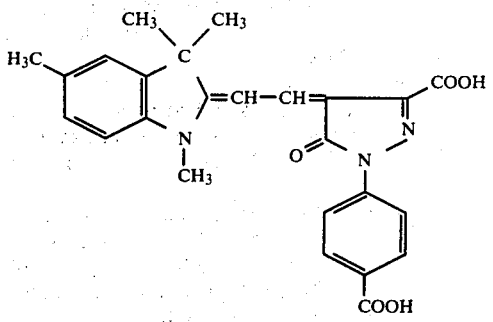

These dyes are added in an amount of from about $10^{-4}$ mol to about 1 mol per 1 mol of ingredient (b), the silver halide or silver halide-forming ingredient.

Ingredient (c), the reducing agent, usde in the present invention is one which can reduce the organic silver salt (ingredient (a)) upon being heated in the presence of exposed silver halide. Of such reducing agents, the one actually used is decided depending upon the kind and property of the organic silver salt used.

Specific examples of the reducing agent are as follows.

(1) Substituted phenols: aminophenols (e.g., 2,4-diaminophenol, methylaminophenol, p-aminophenol, o-aminophenol, 2-methoxy-4-aminophenol, 2-β-hydroxyethyl-4-aminophenol, etc.)., alkyl-substituted phenols (e.g., p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol, p-octylphenol, etc.), aryl-substituted phenols (e.g., p-phenylphenol, o-phenylphenol, α-phenyl-o-cresol, etc.), other phenols (e.g., p-acetophenol, p-acetoacetyl-4-methylphenol, 1,4-dimethoxyphenol, 2,6-dimethoxyphenol, chlorothymol, 3,5-di-t-butyl-4-hydroxybenzyldimethylamine, sulfonamidophenols and those described in U.S. Pat. No. 3,801,321), novolak resin reaction products between formaldehyde and a phenol derivative (e.g., 4-methoxyphenol, m-cresol, o- or p-t-butylphenol, 2,6-di-t-butylphenol, mixture thereof, etc.).

(2) Substituted or unsubstituted bis, tris and tetrakisphenols: o-bisphenols (e.g., 1,1-bis-(2-hydroxy-3,5-dimethylphenyl)-3,5,5-trimethylhexane, bis(2-hydroxy-3-t-butyl-5-methylphenyl)methane, bis(2-hydroxy-3,5-di-t-butylphenyl)-methane, bis(2-hydroxy-3-t-butyl-5-ethylphenyl)methane, 2,6-methylenebis(2-hydroxy-3-t-butyl-5-methylphenyl)4-methylphenol, 1,1-bis(5-chloro-2-hydroxyphenyl)-methane, 2,2'-methylenebis[4-methyl-6-(1-methylcyclohexyl)phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane, 3,3',5,5'-tetramethyl-6,6'-dihydroxytriphenylmethane, 1,1-bis(2-hydroxy-3,5-di-t-butylphenyl)-pentane, 1,1-bis(2-hydroxy-3,5-di-t-butylphenyl)-ethane, 1,1-bis(2-hydroxy-3,5-di-t-butylphenyl)-propane, 1,1-bis-(2-hydroxy-3,5-di-t-butylphenyl)-butane and 1,1-bis(2-hydroxy-3,5-di-t-amylphenyl)ethane), p-bisphenols (e.g., bisphenol A, 4,4'-methylenebis(3-methyl-5-t-butylphenol), 4,4'-methylenebis(2,6-di-t-butylphenol), 3,3',5,5'-tetra-t-butyl-4,4'-dihydroxybiphenyl, 4,4'-dihydroxybiphenyl, 1,1-bis(4-hydroxyphenyl)cyclohexane, 2,2-bis(3,5-dibromo-4-hydroxyphenyl)propane, 2,2-bis(3,5-dichloro-4-hydroxyphenyl)propane, 2,2-bis(3,5-dimethyl-4-hydroxyphenyl)propane, 2,2-bis(3-methyl-4-hydroxyphenyl)propane, bis(3-methyl-4-hydroxy-5-t-butylphenyl)sulfide, 2,2-bis(4-hydroxy-3,5-di-t-butylphenylthio)-propane, 4,4'-butylidenebis(6-t-butyl-3-methylphenol), 4,4'-thiobis(6-t-butyl-3-methylphenol), 4,4'-thiobis(6-t-butyl-2-methylphenol), 4,4'-butylidenebis(6-methylphenol), 4,4'-benzylidene-bis (2-t-butylphenol), 4,4'-ethylidene-bis (6-t-butyl-o-cresol), 4,4'-ethylidenebis (2-t-amylphenol), 4,4'-(p-chlorobenzylidene)-di-(2,6-xylenol) 4,4'-ethylidene-bis (2-cyclohexylphenol), 4,4'-pentylidene-di-(o-cresol), 4,4'-(p-bromo-benzylidene)-di-phenol, 4,4'-propylidene-bis (2-phenylphenol), 4,4'-ethylidene-di-(2,6-xylenol), 4,4'-heptylidene-di-(o-cresol), 4,4'-ethylidene-bis (2,6-di-t-butylphenol) 4,4'-(2-butenylidene)-di-(2,6-xylenol), 4,4'-(p-methylbenzylidene)-di-(o-cresol), 4,4'-(p-methoxybenzylidene)-bis (2,6-di-t-butylphenol) 4,4'-(p-nitrobenzylidene)-di-(2,6-xylenol), 4,4'-(p-hydroxybenzylidene)-di-(o-cresol)), 4,5-di-t-butyl-4-hydroxybenzyldimethylamine, $\alpha,\alpha'$-(3,5-di-t-butyl-4-hydroxyphenyl)-dimethylether, polyphenols (e.g.,2,4,6-tris(3,5-di-t-butyl-4-hydroxybenzyl)phenol, N,N'-di(4-hydroxyphenyl)urea, tetrakis-[methylene-(3,5-di-t-butyl-4-hydroxyhydrocinnamato]methane, etc.), diethylstilbestrol, hexestrol, bis-(3,5-di-t-butyl-4-hydroxybenyl)-ether, 2,6-bis(2'-hydroxy-3'-t-butyl-5'-methylbenzyl)-4-methylphenol, etc.

(3) Substituted or unsubstituted mono- or bis-naphthols and di- or polyhydroxynaphthalenes: bis-$\beta$-naphthols (e.g., 2,2'-dihydroxy-1,1'-binaphthyl, 6,6'-dibromo-2,2'-dihydroxy-1,1'-binaphthyl, 6,6'-di-nitro-2,2'-dihydroxy-1,1'-binaphthyl, bis(2-hydroxy-1-naphthyl)-methane, 4,4-dimethoxy-1,1'-dihydroxy-2,2'-binaphthyl, etc.). naphthols (e.g., $\alpha$-naphthol, $\beta$-naphthol, 1-hydroxy-4-amino-naphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, 1-amino-2-naphthol, sodium 6-sulfonate, 1-naphthylamine-7-sulfonic acid, etc)., sulfonamidonaphthols as described in U.S. Pat. No. 3,801,321, etc.

(4) Di- or poly-hydroxybenzenes and hydroxymonoethers:

hydroquinone, alkyl-substituted hydroquinone (e.g., methylhydroquinone, t-butyl-hydroquinone, 2,5-dimethylhydroquinone, 2,6-dimethylhydroquinone, t-octylhydroquinione, etc.), halogen-substituted hydroquinones (e.g., chlorohydroquinone, dichlorohydroquinone, bromohydroquinone, etc.), alkoxy-substituted hydroquinone (e.g., methoxyhydroquinone, ethoxyhydroquinone, etc.), other substituted hydroquinones (e.g., phenylhydroquinone, etc.), hydroquinone monosulfate, hydroquinone monoethers (e.g., p-methoxyphenol- or p-ethoxyhenol-hydroquinone monobenzyl ether, 2-t-butyl-4-methoxyphenol- or 2,5-di-t-butyl-4-methoxyphenol-hydroquinone mono-n- propyl ether, hydroquinone mono-n-hexyl ether, and other compounds (e.g., catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl-sulfide, methyl gallate, propyl gallate, etc.).

(5) Ascorbic acid and derivatives thereof: l-ascorbic acid, isoascorbic acid, ascorbic acid monoesters (e.g., the monolaurate, monomyristate, monopalmitate, monostearate, monobehenate, etc., of ascorbic acid), diesters of ascorbic acid (e.g., the dilaurate, dimyristate, dipalmitate, distearate, etc., of ascorbic acid). As the ascorbic acids, those described in U.S. Pat. No. 3,337,342 can also be used.

(6) 3-Pyrazolidones and pyrazolones: 1-phenyl-3-pyrazolidone, 4-methyl-4-hydroxymethyl-1-phenyl-3-pyrazolidone, those described in British Pat. No. 930,572, 1-(2-quinolyl)-3-methyl-5-pyrazolone, etc.

(7) Reducing sugars: glucose, lactose, etc.

(8) Phenylenediamines: N,N-dialkyl-p-phenylenediamines (e.g., N,N'-diethyl-p-phenylenediamine, N-phenyl-N'-isopropyl-p-phenylenediamine, etc.). These compounds provide color images when used in combination with phenolic or active methylene color couplers described, in particular, in U.S. Pat. No. 3,531,286. Color images can similarly be obtained according to U.S. Pat. No. 3,761,270.

(9) Hydroxylamines: N,N-di(2-ethoxymethyl)hydroxylamine, etc.

(10) Reductones: anhydro-dihydro-aminohexose reductones, linear aminoreductones as described in Belgian Pat. No. 786,086, etc.

(11) Hydroxamic acids: hydroxamic acids as described in U.S. Pat. Nos. 3,751,252 and 3,751,255, etc.

(12) Hydrazines: hydroxy-substituted aliphatic acid arylhydrazides as described in U.S. Pat. No. 3,782,949, etc.

(13) Others: pyrazolin-5-ones as described in U.S. Pat. No. 3,770,448, indane-1,3-diones having at least one hydrogen atom at the 2-position as described in U.S. Pat. No. 3,773,512, amidoximes as described in U.S. Pat. No. 3,794,488, kojic acid, hinokitiol, hydroxytetronic acid, hydroxytetronamide, sulfohydroxamic acid, p-hydroxyphenylglycine, etc.

Other specific examples of reducing agents used in the present invention are given in U.S. Pat. Nos. 3,152,904, 3,457,075, 3,531,286, 3,615,533, 3,679,426, 3,672,904, 3,751,252, 3,751,255, 3,782,949, 3,770,448, 3,773,512, British Patent 1,338,427, Belgian Pat. No. 786,086, West German Pat. OLS No. 2,031,748, etc.

Of the above-mentioned reducing agents, mono-, bis-, tris-, or tetrakis-phenols having an alkyl group in at least one of the two adjacent positions to the hydroxy-substituted position of the aromatic nucleus (e.g., a methyl group, an ethyl group, a propyl group, an isopropyl group, a butyl group, etc.) or an acyl group, for example, a 2,6-di-t-butylphenol group, have the merit that they suffur less discoloration upon expossure to light due to their high stability against light.

Also, as is described in British Pat. No. 1,163,187, reducing agents which are inactivated by light, e.g., light-decomposable reducing agents, are preferred since they are decomposed or inactivated by light when the light-sensitive material is left in a bright room after development, which serves to avoid light dicoloration due to continuation of the reduction. As light-decomposable reducing agents, there are ascorbic acid or derivatives thereof as earlier exemplified, furoin, benzoin, dihydroxyacetone, glycerinaldehyde, rhodizonic acid, tetrahydroxyquinone, 4-methoxy-1-naphthol, etc. As is described in Japanese Patent Publication 22,185/70 and U.S. Pat. No. 3,756,829, it is also possible to prepare a thermally developable light-sensitive material using such a light-decomposable reducing agent and to obtain direct positive images by image-wise exposing the material to thereby decompose the reducing agent. Further, compounds capable of accelerating the light decomposition of the reducing agent can be used. Still further reducing agents such as the blocked bisphenol compounds as described in U.S. Pat. Nos. 3,589,903, 3,756,829 and Japanese Patent Applications Ser. Nos. 81,625/73 and 22,135/74 can be used. As preferred reducing agents, there can be illustrated at least one ester selected from the group consisting of (1) esters between a carboxylic acid derived from a phenol derivative having a substituent at the o-position and a mono- or polyhydric alcohol or phenol and (2) esters between a polyhydric phenol having a substituent at the o-position or an alcohol derived from a phenol derivative having a bulky substituent at the o-position and a mono- or poly-carboxylic acid. More specific examples of these compounds are those represented by the following general formulae:

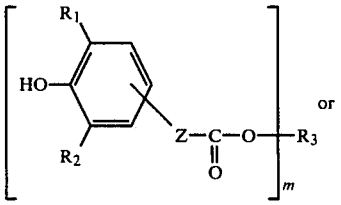

or

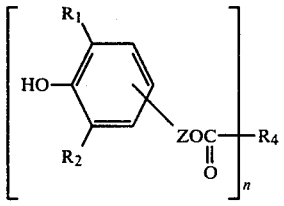

wherein Z represents a divalent group having not more than 30 carbon atoms, $R_1$ represents an alkyl group having 1 to 20 carbon atoms, $R_2$ represents a hydrogen atom or an alkyl group (which can be the same as or different from $R_1$), $R_3$ represents an alcohol residue, $R_4$ represents a carboxylic acid residue, m represents the number of hydroxy groups, and n represents the number of carboxylic acid groups. Specific examples include tetrakis-[methylene-(3,5-di-t-butyl-4-hydroxyhydrocinnamato)]-methane and octadecyl 3-(3',5'-di-t-butyl-4'-hydroxyphenyl)propionate.

Of these esters, compounds represented by the following general formula;

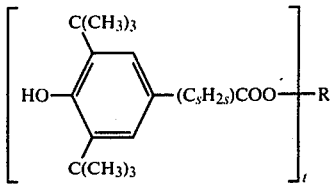

wherein s represents 1, 2, 3 or 4 and the carbon atom of the $C_sH_{2s}$ moiety connected to the phenyl nucleus has at least one hydrogen atom, R represents the residue of a saturated non-cyclic aliphatic alcohol represented by the following general formula;

$$C_dH_{2d+2-t}$$

wherein d represents an integer of 1–18, and t represents an integer of 1 to 2d+2, have been found to be reducing agents capable of providing high image density and a favorable black tone when used in combination with phthalazinone which is added as a preferred activater and toning agent.

Other examples of preferred reducing agents include bisphenols having a 2,4-di-t-butylphenol group or a 2,4-di-t-amylphenol group. As one example thereof, there are compounds represented by the following general formula;

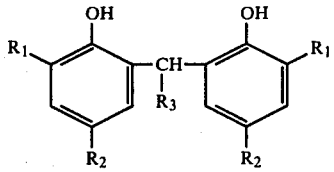

wherein $R_1$ and $R_2$ each represents a t-butyl group or a t-amyl group, and $R_3$ represents a hydrogen atom or an alkyl group having 1–8 carbon atoms.

Suitable reducing agents are selected depending upon the kind (property) of the organic silver salt(s) used (ingredient (a)). For example, reducing agent is suitable for silver salts which are comparatively difficult to reduce such as the silver salt of benzotriazole, silver behenate, etc., whereas weaker ones are suitable for silver salts which are comparatively easy to reduce such as silver caprate, silver laurate, etc. As the reducing agent for the silver salt of benzotriazole, there are 1-phenyl-3-pyrazolidones, ascorbic acid, ascorbic acid monocarboxylic acid esters, naphtols (e.g., 4-methoxy-1-naphthol, etc.), and the like. As the reducing agent for silver behenate, there are many compounds such as o-bisphenols of the bis(hydroxyphenyl)methane series, hydroquinone and the like. Also, as the reducing agent for silver caprate and silver laurate, there are substituted tetrakisphenols, o-bisphenols of the bis(hydroxyphenyl)alkane series, p-bisphenols (e.g., a bisphenol A derivative), p-phenylphenols, and the like.

The amount of the reducing agent used in the present invention varies depending upon the kind of the organic silver salt or the reducing agent and upon other additives, but, in general, a suitable amount ranges from about 0.05 mol to about 10 mols, preferably from about 0.1 to about 3 mols, per 1 mol of the organic silver salt.

The above-described various reducing agents may be used as combinations of two or more. Specific examples of using two reducing agents in combination are described in Japanese Patent Application Ser. No. 27,242/73 and U.S. Pat. Nos. 3,667,958, and 3,751,249. As a particularly effective combination of reducing agents, there are illustrated the combination of at least one carboxylic acid ester derived from a phenol having a bulky o-substituent and an o- or p-bisphenol, the carboxylic acid ester being the aforesaid ester between a carboxylic acid derived from a phenol having a bulky o-substituent and a mono- or poly-hydric alcohol or a phenol or the ester between an alcohol drived from a polyhydric phenol having a bulky o-substituent or from a phenol having a bulky o-substituent and a mono- or poly-carboxylic acid. This combination enables one to attain a reduction of heat fog, an increase in whitness and a stabilization against light exposure after processing. In addition, the combined use of two mono- or poly-phenolic reducing agents having alkyl groups at the two substitution positions adjacent the hydroxy-substituted position of the aromatic nucleus is effective for preventing discoloration upon exposure to light. Further, it has been confirmed that development can be accelerated by the combined use of a compound of tin, iron, cobalt or nickel, for example, a metal salt of long chain fatty acid, e.g., iron stearate, lead behenate, etc. (such compounds are auxiliary reducing agents), and the reducing agent. The amounts of these auxiliary reducing agents vary widely depending upon the reducing power of the main reducing agent and the auxiliary reducing agent and the reducibility of the oxidizing agent (the organic silver salt), but, in general, they are used in an amount of from about $10^{-5}$ to about 1 mol, preferably from $10^{-3}$ to 0.8 mol, per 1 mol of the main reducing agent.

As the one or more thiosulfonic acid compounds (hereafter merely referred to as a thiosulfonic acid for purposes of brevity) used as ingredient (d), which is the most characteristic feature of the present invention, there are those represented by the following general formula $$RSO_2SM$$

wherein R represents (1) a substituted or unsubstituted aliphatic group or (2) a substituted or unsubstituted aryl group, and M represents a cation other than hydrogen. Particularly preferred are substituted or unsubstituted aryl groups for R and, for M, alkaline earth metal ions or alkali metal ions, with alkali metal ions generally being preferred to alkaline earth metal ions.

As to R and M in the above formula, those which are capable of more effectively providing the benefits of the present invention are the following atoms (ions or groups).

1. Regarding R
   (1) Aliphatic groups
      (i) Unsubstituted alkyl groups Alkyl groups having 22 or less carbon atoms are preferred. In particular, alkyl groups having 3–18 carbon atoms are preferred. Specific examples thereof include a hexyl group, a heptyl group, an ethylhexyl group, an octyl group, a nonyl group, a decyl group, a dodecyl group, a hexadecyl group, an octadecyl group, an eicosyl group, a docosyl group, a cyclohexyl group, a t-butyl group, etc.
      (ii) Substituted alkyl groups Substituted alkyl groups having 30 or less carbon atoms and having from 1 to 4 substituents are preferred, and substituted alkyl groups having 2–22 carbon atoms are particularly preferred, and substituent examples include alkoxy groups having 1–8 carbon atoms (e.g., a methoxy group, an ethoxy group, a propoxy group, a butoxy group, a hexyloxy group, etc.), aryl groups having 6–18 carbon atoms (e.g., a phenyl group, a tolyl group, a xylyl group, a biphenylyl group, a t-butylphenyl group, a naphthyl group, a methylnaphthyl group, etc.), and the like.
   (2) Aryl groups
      (i) Unsubstituted aryl groups Those which have 6–30 carbon atoms, in particular 6–22 carbon atoms, are preferred. Specific examples include a phenyl group, a naphthyl group, an anthryl group, etc.
      (ii) Substituted aryl groups The aryl moiety is the same as in item (2) (i) above, and specific examples of the substituents on the aryl moiety (the aryl moiety preferably having from 1 to 4 substituents) are: alkyl groups having 1–8 carbon atoms (a methyl group, an ethyl group, a propyl group, a butyl group, a hexyl group, etc.), alkyl groups having 1–8 carbon atoms and substituted with an aryl group (e.g., a 2-phenylethyl group, a 2-tolylethyl group, a benzyl group, etc.), aryl groups having 6–18 carbon atoms (e.g., a phenyl group, a naphthyl group, a tolyl group, a xylyl group, a biphenyl group, etc.), substituted aryl groups (substituted by an alkyl group, preferably an alkyl group having from 1 to 8 carbon atoms, an aryl group, preferably an aryl group having 6 to 18 carbon atoms or the like), a hydroxy group, a halogen atom, (a chlorine atom, a bromine atom, etc.), an alkoxy group having 1–8 carbon atoms (e.g., a methoxy group, an ethoxy group, a propoxy group, a hexyloxy group, etc.), and acyl groups having 1–8 carbon atoms (e.g., an acetyl group, a propionyl group, a butyryl group, a valeryl group, etc.).

As specific thiosulfonic acids used in the present invention, there can be illustrated sodium n-octylthiosulfonate, potassium n-dodecylthiosulfonate, potassium n-dodecanethiosulfonate, sodium benzylthiosulfonate, sodium n-undecanethiosulfonate, potassium n-tetradecanethiosulfonate, lithium benzylthiosulfonate, potassium n-hexadecanethiosulfonate, potassium 2-ethoxyethylthiosulfonate, sodium benzenethiosulfonate, lithium benzenethiosulfonate, potassium benzenethiosulfonate, sodium p-toluenethiosulfonate, potassium p-methoxybenzenethiosulfonate, potassium p-ethoxybenzenethiosulfonate, sodium 2-naphthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate, potassium 3-acetylbenzenethiosulfonate, etc. In practising the present invention, the thiosulfonic acid compounds can be used as a combination of two or more thereof, if desired, in addition to single use.

Benzotriazoles are effective to prevent heat fog immediately after the preparation of a light-sensitive material. However, when stored under the condition of high temperature and high humidity (e.g., 50° C. 80%), the tone in the image areas changes from black to green or brown and heat fog increases.

While thiosulfonic acids, particularly benzenethiosulfonic acids, are effective to prevent heat fog immediately after preparation and when stored under the conditions of high temperature and high humidity, upon storing under conditions of high temperature and high humidity sensitivity is reduced.

Thus, in one highly preferred embodiment of the present invention, one or more thiosulfonic acids are used in combination with one or more benzotriazoles to provide a heat developable light-sensitive material which is subject to none of the above faults.

The combined use of a thiosulfonic acid, preferably a benzenethiosulfonic acid, and a benzotriazole serves to even further reduce heat fog and to provide a sensitivity which does not change from the time of preparation while permitting a black tone image to be maintained.

The benzotriazoles used as ingredient (e), a highly preferred aspect of the present invention, can be represented by the following general formula:

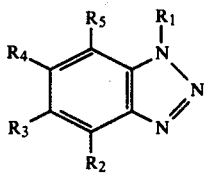

wherein $R_1$ represents a hydroxy group, an alkoxy group (preferably having 1 to 8 carbon atoms), a halogen atom (Cl, Br), an acyl group (preferably having 1 to 8 carbon atoms) or the like, $R_2$ to $R_5$ each represents an alkyl group (having 1 to 12 carbon atoms, which term includes a substituted alkyl group having 1 to 12 carbon atoms and having as a substituent a halogen atom (Cl, Br, I), an alkoxy group having 1 to 4 carbon atoms, a hydroxy group, an amino group, a nitro group, an acyl group having 1 to 4 carbon atoms or a phenyl group), a hydroxy group, an alkoxy group having 1 to 12 carbon atoms, a benzyloxy group, an acyl group having 1 to 8 carbon atoms, an acylamido group (of the formula $NHCOR_6$ where $R_6$ is an alkyl group having 1 to 12 carbon atoms or a phenyl group), a halogen atom (Cl, Br, I), a nitro group, or the like.

As the specific examples thereof, there are the following:

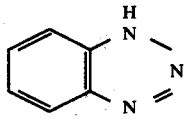

2 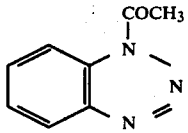

3 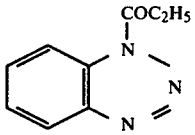

4 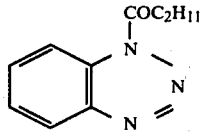

-continued

5 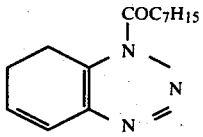

6 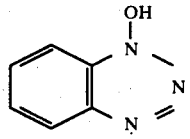

7 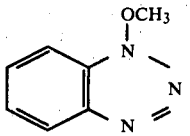

8 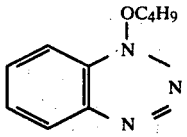

9 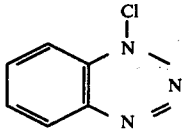

10 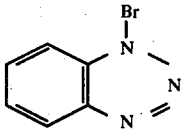

11 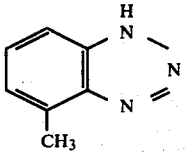

12 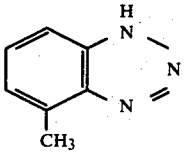

13 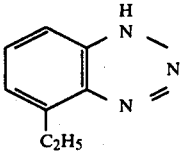

14 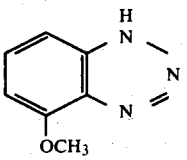

-continued
15 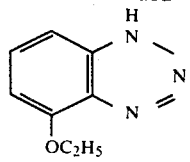
16 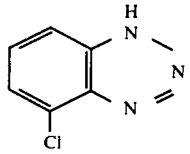
17 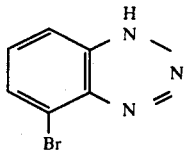
18 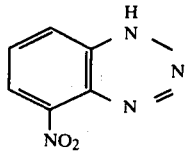
19 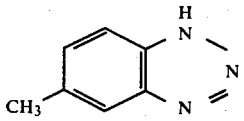
20 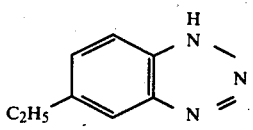
21 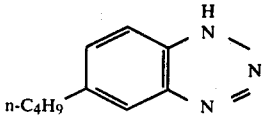
22 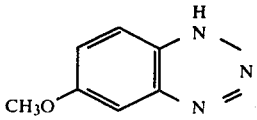
23 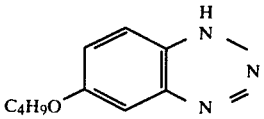
24 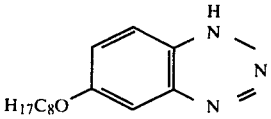
25 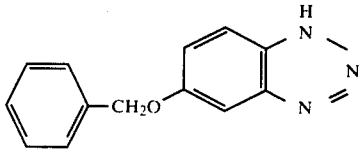
-continued
26 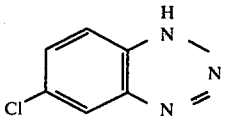
27 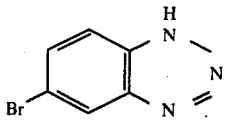
28 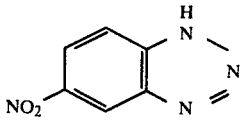
29 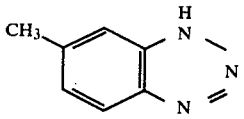
30 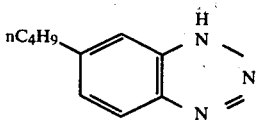
31 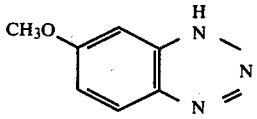
32 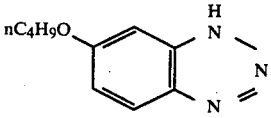
33 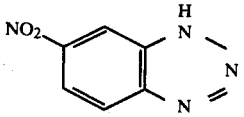
34 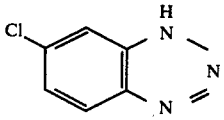
35 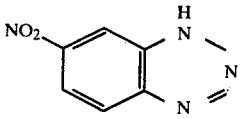
36 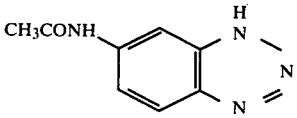
37 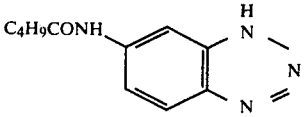

-continued

38

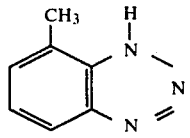

39

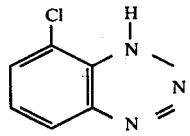

40

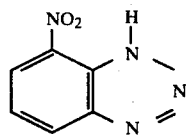

41

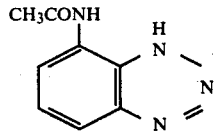

42

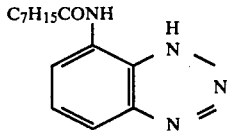

43

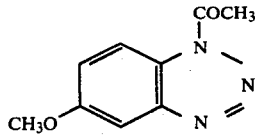

44

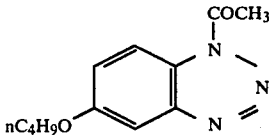

45

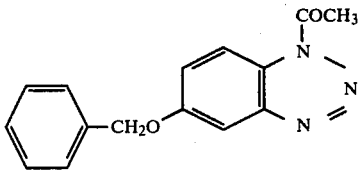

46

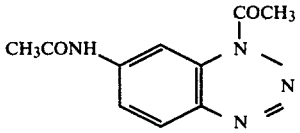

47

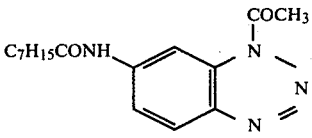

48

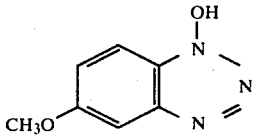

-continued

49

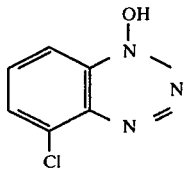

50

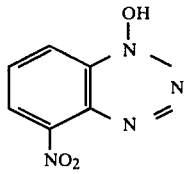

51

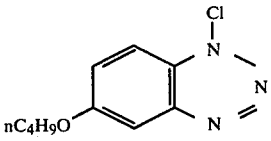

The amount of the thiosulfonic acid(s) used is preferably from about $10^{-5}$ to about 1 mol per mol of the organic silver salt, and an amount ranging from $6\times10^{-4}$ to $10^{-1}$ mol per mol of the organic silver salt is particularly preferred. If the amount used is less than the lower limit, the effect of the present invention tends to become insufficient with decreasing amounts while, if more than the upper limit is used development progress tends to be discontinued with increasing amounts and the maximum density of the resulting images is low. Therefore, such amounts are not preferred.

The amount of the benzothiazole: ingredient (e), ranges from about $1\times10^{-5}$ to about $4\times10^{-1}$ mole preferably from $1\times10^{-3}$ to $2\times10^{-1}$ mol, per 1 mol of the organic silver salt.

The ratio of thiosulfonic acid to benzothiozole is not overly important, and so long as amounts within the above ranges are selected excellent results are obtained.

The thiosulfonic acids and optional benzotriazoles used can be added to the coating solution composition as a dispersion or a solid. However, they are most preferably added as a solution in a suitable solvent.

As to the part of the thermally developable light-sensitive material to which the thiosulfonic acid(s) is to be incorporated, and the benzotriazole, when present, it is most effective to incorporate the same in a light-sensitive layer. However, it is also effective to incorporate the same in the support or provide the same on the surface of the support. In some cases, they can be provided on the back of the support or incorporated in a top-coating layer of the light-sensitive layer. Preferred embodiments are wherein ingredients (a), (b), (c) and (d) are in the same layer and where (a), (b), (c), (d) and (e) are in the same layer.

Although the mechanism of how the thiosulfonic acids and, when present, benzotriazoles, exert the effect of the present invention in thermally developable light-sensitive materials has not yet been clarified, the fact that they markedly prevent heat fog and improve freshness retention was quite surprising to the inventors who have been active in this field for a long time.

In addition to the above-described ingredients, a toning agent can be used in the thermally developable light-sensitive materials of the present invention. A toning agent is often employed where dark images, in particular black images, are desired. The amount thereof to be used ranges from about 0.0001 mol to about 2 mols, preferably from about 0.0005 mol to about 1 mol, per 1 mol of the organic silver salt. Effective toning agents depend upon the organic silver salt and the reducing agent used. However, the most generally used toning agents are heterocyclic organic compounds having at least two hetero atoms and containing at least one nitrogen atom in the hetero ring thereof, as described in U.S. Pat. No. 3,080,254. There can also be used, for example, phthalazone (phthalazinone), maleic anhydride, 2-acetylphthalazinone, 2-phthalylphthaliazinone, substituted phthalazinones as described in Japanese Patent Application Ser. No. 116,022/73, pyrazolin-5-ones as described in Japanese Application Patent (OPI) Ser. No. 6,077/71, cyclic imides such as phthalimide, N-hydroxyphthalimide, N-potassium phthalimide, the silver salt of phthalimide, etc., quinazoline, the silver salt of phthalazinone, mercapto compounds as described in Japanese Patent Applications (OPI) Laid-Open Nos. 5019/74 and 5020/74, mercapto compounds as described in Japanese Patent Application Ser. No. 50,427/73, oxazinediones as described in Japanese Patent Application 50,427, phthalazinediones as described in Japanese Patent Application Ser. No. 116,471/73, uracils as described in Japanese Patent Application Ser. No. 18,378/74, N-hydroxyphthalimide as described in Japanese Patent Application Ser. No. 18,378/74, N-hydroxyphthalimide as described in U.S. Pat. No. 3,782,941, substituted phthalimides described in West. German Pat. Nos. (OLS) 2,140,406, 2,141,063 and 2,220,597, and phthalazinone derivatives as described in West German Pat. (OLS) No. 2,220,618.

In order to prevent discoloration due to light of processed thermally developable light-sensitive materials in accordance with the present invention (the phenomenon of unexposed areas of the light-sensitive materials being gradually discolored upon being exposed to room light after processing), there can be used stabilizer precursors such as azole thioethers as described in Japanese Patent Application (OPI) Ser. No. 318/72 or blocked azole thiones such as 5-acetyl-4-methyl-3-(3-oxo-butyl) thiazoline-2-thione, or tetrazolylthio compounds as described in U.S. Pat. No. 3,700,457 and light-sensitive, halogen-containing organic oxidizing agents as disclosed in U.S. Pat. No. 3,767,377.

In addition, in order to increase the resolving power, light-absorbing dyes as described in Japanese Patent Publication No. 33,692/73 can be used. Further, as is described in Japanese Patent Application Ser. No. 22,135/74, it is possible to remove color stains with dyes by blueing using a blue dye such as Victoria Blue to thereby improve whiteness. In some cases, it is also possible to stabilize processed light-sensitive materials against light and heat. As effective processes therefor, there is stabilizing with a solution containing a mercapto compound as described in U.S. Pat. No. 3,617,289, providing a stabilizer-containing laminate as described in Japanese Patent Publication No. 102,337/73, and the like.

In order to prevent heat fog of the thermally developable light-sensitive material used in practicing the present invention, various compounds can be used in combination with ingredient (d) of the present invention. For example, the mercury compounds as described in Japanese Patent Publication No. 11,113/72, though the use of the mercury compounds is limited due to their toxicity. Also, it is possible to obtain direct positive images by using the mercury compounds as described in, e.g., U.S. Pat. No. 3,559,901. Further, as is described in, e.g., U.S. Patent No. 3,764,328, mercury compounds can be used in combination with color couplers to form stable color images. Still further, there can be used mercury compounds or certain N-halogen compounds in combination to prepare a light-sensitive layer which is stable against light before heating and, after pre-heating before image-wise exposure, become light-sensitive, as described in Japanese Patent Applications )(OPI) Ser. Nos. 80,030/73, 51,626/73, 89,720/73, 10,039,73, and in West German Pat. (OLS) No. 2,315,233.

It is also possible to change sensitivity or contrast by heating before image-wise exposure as described in Japanese Patent Application (OPI) Ser. No. 43,630/73. As other compounds used to prevent heat fog, there are N-halogeno compounds such as N-halogenosuccinimide N-halogenoacetamide, etc., as described in Japanese Patent Application (OPI) Ser. No. 10,274/74 and in Japanese Patent Applications Ser. No. 8,194/73 and 2,842/73. N-halogeno compounds such as N-halogenooxazolinone, N-halogenobenzotriazole, N-halogenobenzimidazole, et., can similarly be used. Furthermore, as is described in, e.g., U. S. Pat. No. 3,645,739, Japanese Patent Applications Ser. Nos. 37,965/73, 43,935/73 and 106,724/73 and in Japanese Patent Application (OPI) Ser. Nos. 89,720/73, etc., there can be used higher fatty acids such as lauric acid, myristic acid, palmitic acid, stearic acid, behenic acid, etc., tetrahalogenophthalic acid or the acid anhydride thereof, arylsulfonic acids such as benzenesulfonic acid, p-toluenesulfonic acid, etc., arylsulfinic acids such as benzenesulfinic acid, p-toluenesulfinic acid, etc. or the salts thereof, lithium salts of higher fatty acids such as lithium myristate, lithium stearate, lithium behenate, lithium palmitate, lithium laurate, etc. As other acid stabilizers, there can also be used salicylic acid, p-hydroxybenzoic acid, tetrabromobenzoic acid, tetrachlorobenzoic acid, p-acetamidobenzoic acid, alkyl-substituted benzoic acids (e.g., p-t-butylbenzoic acid, etc.), phthalic acid, isophthalic acid, trimellitic acid, pyromellitic acid, diphenic acid, 5',5'-methylenebis-salicylic acid, etc. Rosin or diterpenic acid, etc., can also be used.

However, as has been described before, these compounds sometimes cause side effects such as a reduction of sensitivity, a deterioration of stability against light, a reduction of image density, and the like. Therefore, care should be taken as to the amount thereof used. It is preferred to use thiosulfonic acids and higher fatty acids having 10 or more carbon atoms in combination. Also, it is particularly preferred to use thiosulfonic acids and rosin or diterpinic acid in combination. In addition, as effective compounds capable of being used in combination with the ingredient (d) of the present invention, there can be illustrated thiouraciles such as the 2-thiouracils represented by the following general formula;

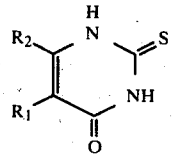

wherein $R_1$ represents a hydrogen atom, a hydroxy group, an alkoxy group, a halogen atom, a substituted lower alkyl group or an unsubstituted alkyl group, a benzyl group, an allyl group, an amino group, a nitro group or a nitroso group, and $R_2$ represents a hydrogen atom, a hydroxy group, a halogen atom, an amino group, an acetoamide group, a substituted or unsubstituted alkyl group having 1 to 22 carbon atoms, an aryl group or a substituted aryl group, e.g., a phenyl group or a substituted phenyl group; mercapto compounds such as 1-phenyl-5-mercaptotetrazole, etc., azolethioethers or blocked azolethiones, peroxides or persulfates as described in Japanese Patent Application Ser. No. 5,453/74, disulfides such as

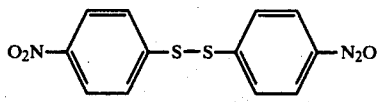

and the like. Further, the presence of chromium salts, rhodium salts, copper salts, nickel salts, cobalt salts, a complex salt of rhodium, iron, cobalt, palladium or the like during or before the formation of silver halide is effective to improve photographic properties such as prevention of heat fog and sensitization. Examples of such materials include nickel nitrate, rhodium triamonate, cobalt acetylacetate, and the like.

Each ingredient used in the present invention is dispersed in at least one colloid as is conventionally used in the art as a binder. Preferred binders are generally hydrophobic, though hydrophilic binders may also be used. These binders are transparent or semi-transparent and include, for example, proteins such as gelatin, gelatin derivatives, etc., polysaccharides such as cellulose derivatives, dextran, etc., naturally occurring materials such as gum arabic, latex-like vinyl compounds capable of improving the dimensional stability of photographic materials, and synthetic polymers. As preferred synthetic polymers, there are illustrated those as described in U.S. Pat. Nos. 3,142,586, 3,193,386, 3,062,674, 3,220,844, 3,287,289, 3,411,911, etc. As very effective polymers binders, there are water-insoluble polymers prepared from monomers such as alkyl acrylates, alkyl methacrylates, acrylic acid, sulfoalkyl acrylates, sulfoalkyl methacrylates, or the like, or compounds having a repeating sulfobetaine unit as described in Canadian Pat. No. 774,054.

As preferred high molecular weight synthetic or natural resins, there can be illustrated polyvinyl butyral, polyacrylamide, cellulose, acetate butyrate, cellulose acetate propionate, polymethyl methacrylate, polyvinyl pyrrolidone, polystyrene, ethyl cellulose, polyvinyl chloride, chlorinated rubbers such as chloroprene, polyisobutylene, butadiene-styrene copolymers, vinylchloride-vinyl acetate copolymers, vinyl chloride-vinyl acetate-maleic acid terpolymers, polyvinyl alcohol, polyvinyl acetate, benzyl cellulose, cellulose acetate, cellulose propionate, cellulose acetate phthalate, etc. Of these polymers, polyvinyl butyral, polyvinyl acetate, ethyl cellulose, polymethyl methacrylate, and cellulose acetate butyrate are particularly preferred. If desired, two or more binders may be used in combination. The proportion of the binder ranges from about 10:1 to about 1:10, preferably from about 4:1 to about 1:4, by weight based on the organic silver salt ingredient (a).

A layer or layers containing the respective ingredients used in the thermally developable light-sensitive materials of the present invention can be coated on supports of various materials as are conventionally used in the art. As the support, one of any shape can generally be used but, since flexible supports are preferred for handling as information-recording materials, film- or sheet-shaped support are generally used. As the material for the support, there can be illustrated films or sheets of cellulose nitrate, cellulose esters (including partially acylated esters), polyvinyl acetal, polyethylene, polyethylene terephthalate, polycarbonate or like plastics, glass, paper, aluminum or like metals, etc. Baryta paper, resin-coated paper, water-proof paper, and the like may also be used. As paper supports, clay papers such as art paper and clay-coated paper are the most suitable. Papers subjected to sizing with polysaccharides or the like may also be used.

In addition to providing the aforesaid various layers on the support, some of the ingredients may be incorporated in the support itself. When the ingredients are incorporated in a plastic, glass, metal or like support, it is, of course, difficult for the ingredients to fully exert their functions. However, with the support being, for example, paper-based, absolutely the same effects can be obtained, even when a certain ingredient or ingredients are incorporated in the support (paper-based), as that in the case of incorporating the ingredient(s) in a layer provided on the support. It can easily be decided, depending upon the intentions of the user of the present invention and upon the conditions, including the necessary and advantageous production steps, whether the ingredients are to be incorporated in the support or in a layer provided on the support.

As to the amount of silver to be provided on a support, the organic silver salt and silver halide are used in such amount that the sum amount of silver contained in the two falls within the range of from about 0.2 g to about 3 g, preferably from about 0.3 g to about 2 g, per 1 $m^2$ of the support.

The thermally developable light-sensitive materials of the present invention can comprise an antistatic layer or conductive layer. Into these layers there can further be incorporated water-soluble salts (e.g., halides, nitrates, etc.), ionic polymers as described in U.S. Pat. Nos. 2,861,056 and 3,206,312, and water-insoluble inorganic salts as described in U.S. Pat. No. 3,428,451. Also, the materials of the present invention may have a vacuum-deposited metal layer. For example, such a vacuum deposited metal layer can be on the opposite surface of the support to the surface carrying the light-sensitive layer. Examples of metals in such a layer include tin, silver, iron, nickel and the like. Vacuum deposition or sputtering can be used, if desired. If desired, the thermally developable light-sensitive materials of the present invention may have incorporated therein an antihalation substance or a halation-preventing dye. As suitable dyes, those which decolor upon heating are preferred. Further, filter dyes or light-absorbing substances as described in U.S. Pat. Nos. 3,253,921, 2,527,583, 2,956,879, etc., can also be incorporated therein. If desired, in the thermally developable light-sensitive material of the present invention there may be incorporated matting agents such as starch, titanium dioxide, zinc oxide, silica, polymer beads including those described in U.S. Pat. Nos. 2,922,101 and 2,761,245, alumina, kaolin, clay and the like. Also, there can be incorporated therein fluorescent brightening agents such as stilbenes, triazines, oxazoles, coumarins, etc., which can be used as an aqueous solution or a dispersion.

In the thermally developable light-sensitive materials of the present invention there may further be incorporated a plasticizer and/or a lubricant. As preferred materials, there can be illustrated, glycerin, diols, fatty acids or esters thereof as described in U.S. Pat. Nos. 2,588,765 and 3,121,060, and silicon resins as described in British Pat. 955,061. Further, there can be incorporated therein surface active agents such as saponin and alkylarylsulfonates as described in U.S. Pat. No. 2,600,831, amphoteric compounds as described in U.S. Pat. No. 3,133,816, glycidol-alkylphenol adducts as described in British Pat. No. 1,022,878, etc.

Of the thermally developable light-sensitive layers in the thermally developable light-sensitive material of the present invention, hardenable layers can be hardened with various organic or inorganic hardeners. Hardeners can be used alone or in combination. As suitable hardeners, there can be illustrated aldehydes, blocked aldehydes, ketones, derivatives of carboxylic acids and carbonic acid, sulfonate esters, sulfonyl halides, vinylsulfonyl esters, active halogen compounds, epoxy compounds, aziridine, active olefins, isocyanates, carbodiimides, polymeric hardeners (e.g., dialdehyde starch, etc.), and the like.

Further, in order to raise the density of the resulting images, various additives are used. For example, compounds having a —CO—, —SO— or —$SO_2$— group as described in U.S. Pat. No. 3,667,959, such as non-aqueous polar organic solvents (e.g., tetrahydrothiophene-1,1-di-oxide-4-hydroxybutanonic acid lactone, methylsulfinylmethane, etc.) are effective. In addition, acetic acid salts of zinc, cadmium or copper as described in U.S. Pat. No. 3,708,304 are also effective. Furthermore, compounds containing water of crystallization as described in Japanese Patent Publications No. 26,582/69 and 18,416/70 and compounds capable of becoming alkaline upon heating (e.g., acid salts of amines, metal oxides or hydroxides, etc.) are effective as substances to accelerate development.

In addition, as is described in U.S. Pat. No. 3,666,477, it is possible to use a polyalkylene glycol in combination with mercaptotetrazole in order to improve sensitivity, contrast and image density.

In the thermally developable light-sensitive materials of the present invention there may be provided a subbing layer intermediate a support and a thermally developable light-sensitive layer. As the binder to be used for this subbing layer, various polymers as already mentioned can be used. For example, there can be illustrated polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl chloride-vinyl acetate-maleic acid terpolymers, polyvinyl alcohol, polyvinyl acetate, cellulose acetate, cellulose propionate, cellulose acetate phthalate, gelatin, gelatin derivatives, polysaccharides, etc.

Photographic properties such as light discoloration and heat fog can be improved by incorporating a fatty acid or fatty acid metal salt in the subbing layer. Further, solvent permeation can be prevented by incorporating clay or like pigments therein. Still further, there can be incorporated therein matting agents such as alumina, starch, silica, kaolin, titanium dioxide, zinc oxide, etc. Also, a layer of a conductive metal be electrolytically deposited as described in U.S. Pat. No. 3,748,137.

In the case of using a paper as a support, humidity resistance can be increased and curling can be prevented by providing a polymer layer (preferably hydrophobic) on a back of the support.

As is described in Japanese Patent Application (OPI) 6,917/74, top-coating polymer layer can be provided, if desired, on a light-sensitive layer in order to increase the transparency of the thermally developable light-sensitive material, raise image density and improve freshness retention capability. The film thickness of the top-coating polymer layer is suitably from about 1$\mu$ to about 20$\mu$. As suitable polymers therefor, there can be illustrated, e.g., polyvinyl chloride, polyvinyl acetate, vinyl chloride-vinyl acetate copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate, polyvinyl pyrrolidone, etc. Also, as is described in Belgian Pat. No. 798,367 and Japanese Patent Application Ser. No. 97,050/73, the incorporation of kaolin, silica, a polysuccharide (e.g., starch, etc.) or a like carrier in a top-coating polymer layer enables one to write thereon using stamp ink, for example, ink as is used to impregnate an inking pad or the like, cinnabar seal ink, a ball point pen, a pencil or the like. In the top-coating polymer layer there may also be incorporated a filter dye, an ultraviolet ray absorbant or an acid stabilizer (e.g., a higher fatty acid, etc.).

After being cut into a suitable size for use, the thus prepared thermally developable light-sensitive material is image-wise exposed. The material may be pre-heated (80° C.–140° C.), if desired, before exposure. Such preheating assists to stabilize the sensitivity and the shape of the photographic characteristic curve of the material. As the light source suitable for the image-wise exposure, there can be illustrated various light sources such as a tungsten lamp, a fluorescent lamp for copying mainly used for exposing diazo light-sensitive materials, a mercury lamp, an iodine lamp, a xenon lamp, a CRT light source, a laser light source, etc. As a copying original, photographic images may be used as well as light images of a drawing. In addition, it is also possible to take pictures using a camera. The materials of the present invention can also be printed, e.g., by contact printed by superposing an original thereon, or reflection printing or enlarging printing can also be conducted. The exposure amount varies depending upon the sensitivity of the light-sensitive material, and is about 10 lux.sec with respect to a highly sensitive material or about $10^4$ lux.sec with respect to a materials of low sensitivity, with exposure intensities of about 0.1 lux.sec. to about $10^5$ lux.sec. being adequate for most generally used commercial products.

The thus image-wise exposed light-sensitive material can be developed merely be heating (generally, heating is at about 80° C. or above, and generally at less than about 180° C.; for most commercial materials a heating range of about 100° C. to about 150° C. is adequate). The heating time can be optionally settled between about 1 to about 60 seconds or can be set this. The exact heating time is decided depending upon the heating temperature. Usually, a heating time of about 5 seconds to about 40 seconds at 120° C., about 2 seconds to about 20 seconds at 130° C. and about 1 second to about 10 seconds at 140° C. are suitable.

Various heating means can be used and the exact heating means is not critical. For example, the thermally developable light-sensitive material may be brought into contact with a simple heated plate or a heated drum. If desired, it may be passed within an appropriate heating space. In order to prevent offensive odors from being generated upon heating by high frequency induction heating or by heating with a laser beam, a deodorant may be provided in the processing machine. Also, a perfume can be incorporated in the material itself to prevent offensive odors from the light-sensitive material from being detected.

The thermally developable light-sensitive material in accordance with the present invention has the merits that heat fog is prevented and good freshness retention capability is obtained.

One process for preparing thermally developable light-sensitive materials of the present invention is specifically described below.

An organic silver salt-forming agent and a silver ion-supplying agent (e.g., silver nitrate, etc.) are reacted with each other in one of the earlier manners to form an organic silver salt. The preparation conditions are properly selected within the range of from about −15° C. to about +80° C. at atmospheric pressure. Usually, a temperature of about 20° C. to about 60° C. is suitable. After washing with water, alcohol or the like, the thus prepared organic silver salt is dispersed in the binder(s) for the emulsion. For dispersion, a colloid mill, a mixer, a ball mill or the like may be used. Dispersion is usually effected at ordinary temperature (15° C.-25° C.). To the thus prepared silver salt polymer dispersion there is added a silver halide-forming agent to partly convert the organic silver salt into silver halide. The reaction temperature is suitably from ordinary temperature to about 80° C., and the reaction time can optionally be selected within the range of from about 1 minute to about 48 hours. As has already been stated, previously prepared silver halide may be added or silver halide may be prepared simultaneously with the organic silver salt (in situ formation). Various additives such as a sensitizing dye, a reducing agent, a toning agent, etc., are then conveniently added one by one, preferably as solutions, usually, being added one after another at short interval (typically about 5 to about 20 minutes) while stirring at ordinary temperature to about 50° C.

The benzotriazoles and thiosulfonic acids, preferably benzenethiosulfonic acids, can be added during, before or after the formation of the organic silver salt, after the formation of silver halide, or before or after the addition of the reducing agent and the toning agent. However, they are preferably added after the formation of the organic silver salt-silver halide, or before or after the addition of the reducing agent and the toning agent.

A coating solution is thus formed after adding all of the desired additives in the above manner. The coating solution is coated on a suitable support as such by conventional methods. Other desired layers such as a top-coating polymer layer, subbing layer, backing layer and the like can be formed in a similar manner by preparing respective coating solutions and coating, in sequence, by various conventional coating processes such as dip coating, air knife coating, curtain coating or hopper coating. It is also possible, if desired, to coat two or more layers at the same time according to the process as described in U.S. Pat. No. 2,761,791 and British Pat. No. 837,095.

The thermally developable light-sensitive material of the present invention possesses the capability that the photographic properties thereof are liable to be deteriorated by high humidity. Therefore, in shipping the resulting light-sensitive materials it is preferred have a desiccant present as described in Japanese Patent Application Ser. No. 50,429/73.

The present invention will now be illustrated in more detail by the following non-limiting examples of preferred embodiments of the present invention. Unless otherwise indicated all processing were at room temperature (approx. 25° C.). In the examples, after each coating solution was coated on the support it was dried. In all examples, further, the silver salt dispersion was dispersed in the binder by ball milling or mixing for a conventional period of time, typically on the order of 1 hour.

EXAMPLE 1

A solution prepared by dissolving 1.9 g of sodium hydroxide in 100 ml of water was mixed with a solution prepared by dissolving 12 g of lauric acid in 100 ml of toluene and the system emulsified. To this emulsion there was then added an aqueous solution prepared by dissolving 8.5 g of silver nitrate in 50 ml of water. Upon allowing the system to stand for 5 minutes, the resulting mixture separated into a toluene phase containing silver laurate and an aqueous phase. After removing the aqueous phase, 200 mol of ethanol was added to the toluene phase to redisperse the silver salt. Silver laurate was then collected by centrifugation. There was thus obtained 12 g of spindle-shaped silver laurate crystals of about 3 μ in length.

6 g of the thus obtained silver laurate (about 1/50 mol) and 12 g of polyvinyl butyral [DENKA BUTYLAL 4000.2 (Denki Kagaku Kabushiki Kaisha)] were dispersed in 70 g of ethyl alcohol using a mixer to prepare a polymer dispersion of the silver salt.

The silver salt polymer dispersion was maintained at 50° C., and, while stirring, 15 ml of a 1.1% by weight acetone solution of N-bromoacetamide (silver halide-forming component) was added in 8 portions at intervals of 5 minutes (15/8 ml per addition), followed by heating at 50° C. for 90 minutes. The temperature was then maintained at 30° C. and, while stirring, the following ingredients were added in the recited sequence at 5 minutes intervals to prepare a coating dispersion, which was referred to as coating despersion A-1.

(1) 0.025% by weight methyl cellosolve solution of the merocyanine dye (sensitizing dye) represented by the following formula; 10 ml

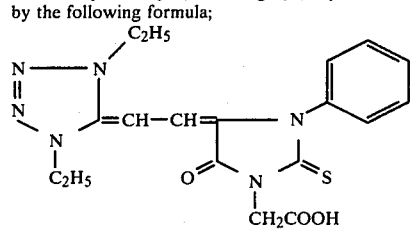

(2) 0.2% by weight methanol solution of sodium benzenethiosulfonate 4 ml (3) 10% ethanol solution of "TEST NO. 906A3111" (trade name of rosin made by Kanto Kagaku Kabushiki Kaisha) 8 ml (4) 3% by weight methanol solution of phthalazinone (toning agent) 16 ml (5) 40% by weight acetone solution of the compound represented by the following -continued formula; 13 ml

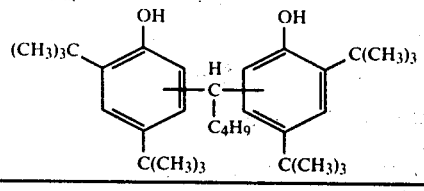

In the same manner as with coating dispersion A-1 except for omitting the addition of the ethanol solution of "TEST NO. 906A3111", there was obtained a coating dispersion referred to as coating dispersion A-2. The two coating dispersions were for the preparation of thermally developable light-sensitive materials of the present invention.

In the same manner as with coating dispersion A-1 except for omitting the addition of sodium benzenethiosulfonate, there was prepared a coating dispersion referred to as coating dispersion A-3 (to prepare a Comparative Sample).

Furthermore, in the same manner as with coating dispersion A-1 except for adding 8 ml of a 0.2% by weight ethanol solution of mercury acetate in place of the methanol solution of sodium benzenethiosulfonate and the ethanol solution of "TEST NO. 906A3111", there was prepared a coating dispersion referred to as coating dispersion A-4 (to prepare a Comparative Sample).

Each of these 4 coating dispersions was coated on a polyethylene terephthalate film in an amount of 1.2 silver/$m^2$ and, after drying, a 5% by weight tetrahydrofuran solution of vinyl chloride-vinyl acetate copolymer (copolymerization molar ratio: vinyl chloride/vinyl acetate = 87/13) was coated thereon to provide a 1 $\mu$ dry thickness and dried to prepare 4 thermally developable light-sensitive materials which were referred to as Samples A-1, A-2, A-3 and A-4, respectively.

Each of these Samples was exposed through an optical wedge in an amount of $10^3$ lux.sec, and heated for 15 seconds or 20 seconds at 120° C. to obtain black images. Then, the transmission density of each Sample was measured, and the reciprocal of the exposure amount necessary to provide a transmission density of fog+0.1 was calculated as the scale of sensitivity. In Tables 1 and 2 the relative sensitivity (taking the sensitivity of Sample A-4 obtained by developing at 120° C. for 15 seconds as 100), heat fog and maximum density values obtained are shown.

TABLE 1

(Developing conditions: 120° C., 15 sec)

| Sample | Relative Sensitivity | Heat Fog | Maximum Density |
|---|---|---|---|
| A-1 | 115 | 0.04 | 2.31 |
| A-2 | 102 | 0.05 | 2.11 |
| A-3* | 63 | 0.95 | 2.40 |
| A-4* | 100 | 0.06 | 2.19 |

*Comparative Samples

TABLE 2

(Developing conditions: 120° C., 20 sec)

| Sample | Relative Sensitivity | Heat Fog | Maximum Density |
|---|---|---|---|
| A-1 | 195 | 0.06 | 2.32 |
| A-2 | 145 | 0.10 | 2.25 |
| A-3* | — | 2.03 | 2.43 |

TABLE 2-continued (Developing conditions: 120° C., 20 sec)

| Sample | Relative Sensitivity | Heat Fog | Maximum Density |
|---|---|---|---|
| A-4* | 120 | 0.09 | 2.15 |

*Comparative Samples

From the results shown in Tables 1 and 2, it is seen that Samples A-1 and A-2 in accordance with the present invention showed high relative sensitivity and an excellent heat fog-preventing property and maximum density as compared to the Comparative Samples. Of the Comparative Samples, Samples A-4 using the mercury compound showed comparatively good properties. However, the Samples in accordance with the present invention showed between properties than that and, particularly in the case of long-time development, there were observed differences in relative sensitivity and maximum density.

Then, fresh light-sensitive Samples not having been subjected to the above-described image-forming processing were placed in a sealed container and left for 24 hours at 50° C. and 80% RH. The Samples were then taken out and subjected to the same image-forming processing as described above, followed by sensitometry. The results are shown in Tables 3 and 4. The standard of relative sensitivity was the same as above.

TABLE 3

(Developing Conditions: 120°0 C., 15 sec)

| Sample | Relative Sensitivity | Heat Fog | Maximum Density |
|---|---|---|---|
| A-1 | 49 | 0.03 | 1.13 |
| A-2 | 35 | 0.03 | 1.08 |
| A-3* | — | 1.03 | 1.10 |
| A-4* | 32 | 0.08 | 1.02 |

*Comparative Samples

TABLE 4

(Developing Conditions: 120° C., 20 sec)

| Sample | Relative Sensitivity | Heat Fog | Maximum Density |
|---|---|---|---|
| A-1 | 101 | 0.04 | 1.81 |
| A-2 | 69 | 0.06 | 1.73 |
| A-3* | — | 1.80 | 1.82 |
| A-4* | 52 | 1.11 | 1.69 |

*Comparative Samples

From the results given in Tables 3 and 4, a similar conclusion was obtained. Thus, the properties of thermally developable light-sensitive materials in accordance with the present invention were found to be extremely excellent. Sample A-1 which contained rosin in addition to the thiosulfonic acid compound of the present invention showed much more excellent properties as compared with the other Samples. This was considered to be based on the general effects due to the use of the thiosulfonic acid compound. Similar effects can be expected when other thiosulfonic acid compounds are used.

EXAMPLE 2

In the same manner as with Sample A-1 except for using the compounds shown in Table 5 in place of sodium benzenethiosulfonate, there were prepared thermally developable light-sensitive materials, which were referred to as Samples A-5, A-6, A-7, A-8 and A-9, respectively.

TABLE 5

| Sample | Additive | Concentration in Amount Methanol Solution added (% by weight) | (ml) |
|---|---|---|---|
| A-5 | Sodium n-octylthiosulfonate | 0.4 | 5 |
| A-6 | Lithium benzylthiosulfonate | 0.3 | 8 |
| A-7 | Sodium p-toluenethiosulfonate | 0.1 | 4 |
| A-8 | Potassium p-methoxythiosulfonate | 0.2 | 10 |
| A-9 | Potassium benzenethiosulfonate | 0.2 | 12 |

When the Samples were heated for 15 seconds at 120° C. after exposing through an optical wedge in an amount of $10^3$ lux.sec, there were obtained black images. Table 6 shows the results of sensitometry conducted in the same manner as in Example 1. Additionally, relative sensitivities are shown taking the sensitivity of Sample A-3 in Example 1 as 100.

TABLE 6

| Sample | Relative Sensitivity | Heat Fog | Maximum Density |
|---|---|---|---|
| A-3(Comparative Sample) | 100 | 0.95 | 2.40 |
| A-5 | 109 | 0.11 | 2.36 |
| A-6 | 118 | 0.06 | 2.38 |
| A-7 | 153 | 0.07 | 2.43 |
| A-8 | 128 | 0.02 | 2.28 |
| A-9 | 130 | 0.01 | 2.31 |

From the results shown in Table 6, it was observed that the Samples of the present invention underwent extremely less heat fog and showed considerably high sensitivity as compared with the Comparative Sample.

EXAMPLE 3

A polymer dispersion of a silver salt was prepared in the same manner as in EXAMPLE 1 and, while maintaining the temperature at 40° C., 15 ml of a 1.5% by weight acetone solution of N-bromosuccinimide was added thereto, followed by heating for 150 minutes at 40° C. Then, while stirring at 20° C., the following ingredients were added in the recited sequence at 5 minutes intervals to prepare a coating dispersion which was called coating dispersion B-1.

(1) 0.025% by weight methanol solution of the dye represented by the following chemical formula; 8 ml

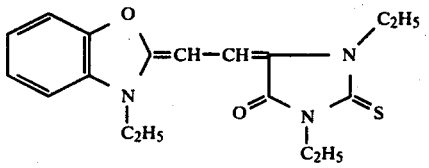

(2) 0.02% by weight methanol solution of sodium benzenethiosulfonate 8 ml (3) 5% by weight toluene solution of palmitic acid 13 ml (4) 3% by weight methanol solution of phthalazinone (toning agent) 26 ml (5) 20% by weight acetone solution of the compound represented by the following formula (reducing agent); 28 ml -continued

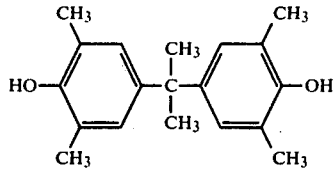

Then, in the same manner as with coating dispersion B-1 except for omitting the addition of the palmitic acid toluene solution, there was prepared a coating dispersion which was called coating dispersion B-2. In order to prepare other Samples, there was prepared a coating dispersion B-3* in the same manner as with coating dispersion B-1 except for omitting the addition of sodium benzenethiosulfonate. In order to obtain another Comparative Sample, the same procedure as for coating dispersion B-1 was followed except for adding 6 ml of a 0.2% by weight ethanol solution of mercury bromide in place of the addition of the methanol solution of sodium benzenethiosulfonate to prepare coating solution B-4. Each of these 4 coating dispersions was coated on art paper in an amount of 0.4 g silver/$m^2$ and dried to prepare thermally developable light-sensitivie materials, which were referred to as Sampls B-1, B-2, B-3 and B-4, respectively.

* Comparative

When these Samples were heated for 15 seconds at 140° C. after exposing them through an optical wedge in an exposure amount of $1\times10^3$ lux.sec, there were obtained black images. They were then subjected to the same sensitometry as in Example 1. The results thereof are shown in Table 7.

TABLE 7

| Sample | Relative Sensitivity | Heat Fog | Maximum Density |
|---|---|---|---|
| B-1 | 125 | 0.07 | 1.44 |
| B-2 | 105 | 0.10 | 1.45 |
| B-3* | 48 | 1.03 | 1.44 |
| B-4* | 100 | 0.13 | 1.43 |

*Comparative Samples

From the results shown in Table 7, it was clear that Samples B-1 and B-2 of the present invention were markedly excellent in relative sensitivity and heat fog-preventing property as compared with Sample B-3 which did not contain a thiosulfonic acid of the present invention. Further, it is worth noting that there were obtained values exceeding the properties of Sample B-4 using a conventional mercury compound.

EXAMPLE 4

3.4 g of behenic acid was dissolved in 100 ml of benzene at 60° C., and, while stirring this solution at the same temperature, 100 ml of water was added to the solution to emulsify the system. Subsequently, an aqueous solution (10° C.) prepared by adding aqueous 28 wt% ammonia to about 80 ml of an aqueous solution containing 1.7 g of silver nitrate to form a silver ammonium complex salt and making the total amount 100 ml with water was added thereto (28 wt% aqueous ammonia; addition up to where the complex was formed.)

There was thus formed fine crystals of silver behenate. Upon standing for 20 minutes the system separated into an aqueous phase and a benzene phase.

The aqueous phase was first removed. Then, 400 ml of fresh water was added thereto to wash (decantation) the same. Then, 400 ml of methanol was added thereto and silver behenate collected by centrifugation. There was thus obtained 4 g of spindle-shaped silver behenate about 1 μ in length and about 0.05 μ in width.

2.3 g of this silver behenate was dispersed in 20 ml of an ethanol solution containing 2.5 g of polyvinyl butyral as was used in EXAMPLE 1. To this silver salt polymer dispersion was added 2 ml of a 2.5% by weight methanol solution of N-bromoacetamide (silver halide-forming ingredient) and the system heated at 50° C. for 120 minutes. The following ingredients were added to this silver salt polymer dispersion in the recited sequence at 5 minute intervals to prepare coating dispersion C-1.

(1) 0.025% by weight methyl cellosolve solution of the sensitizing dye represented by the following chemical formula; 1 ml

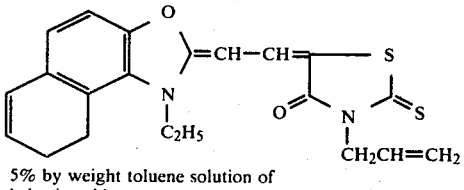

(2) 5% by weight toluene solution of behenic acid 15 ml
(3) 0.3% by weight methanol solution of potassium p-toluenethiosulfonate 1 ml
(4) 25% by weight acetone solution of 2,2'-methylenebis (6-t-butyl-4-methylphenol) (reducing agent) 3 ml
(5) 3% by weight methanol solution of phthalazinone (toning agent) 5 ml In the same manner as for coating dispersion C-1 except for omitting the addition of potassium p-toluenethiosulfonate, there was obtained a coating dispersion which was referred to as coating dispersion C-2.

Each of these two coating dispersions was coated on a polyethylene terephthalate film in an amount of 1.7 g silver/m$^2$ and dried. Then, a 5% by weight tetrahydrofuran solution of vinyl chloride-vinyl acetate copolymer was coated thereon to provide a dry thickness of 1 μ and dried to prepare two thermally developable light-sensitivie materials, which were referred to as Samples C-1 and C-2, respectively.

The two Samples were then subjected to the same sensitometry as in EXAMPLE 1 except for conducting heat-development at 120° C. for 23 seconds and using an exposure of 10,000 lux.sec. The results obtained were as follows.

TABLE 8

| Sample | Relative Sensitivity | Heat Fog | Maximum Density |
|---|---|---|---|
| C-1 | 230 | 0.11 | 2.44 |
| C-2* | 100 | 1.89 | 2.31 |

*Comparative Sample

From the results shown in Table 8, it is clear that Sample C-1 in accordance with the present invention has extremely excellent properties in that relative sensitivity is markedly high while heat fog is extremely small.

EXAMPLE 5

A solution prepared by dissolving 1.9 g of sodium hydroxide in 100 ml of water was mixed with a solution prepared by dissolving 12 g of lauric acid in 100 ml of toluene and the system emulsified. To this emulsion there was added an aqueous solution prepared by dissolving 8.5 g of silver nitrate in 50 ml of water. Upon allowing the system to stand for 5 minutes, it separated into a toluene phase and an aqueous phase. After removing the aqueous phase, 200 ml of ethanol was added to the toluene phase to redisperse the silver salt. Silver laurate was collected by centrifugation. There was thus obtained 12 g of spindle-shaped lauric acid silver salt of about 3 μ in length. 6 g of the thus obtained silver laurate (about 1/50 mol) and 12 g of polyvinyl butyral* were dispersed in 70 g of ethyl alcohol using a mixer to prepare a polymer dispersion of the silver salt.

* As in Example 1.

This silver salt polymer dispersion was maintained at 50° C. and, while stirring, 15 ml of a 1.1% by weight acetone solution of N-bromoacetamide (silver halide-forming component) was added in equal 8 portions at 5 minute intervals (15/8 ml/portion, followed by heating for 90 minutes at 50° C. The temperature was maintained at 30° C. and, while stirring, the following ingredients were added in the recited sequence at 5 minute intervals to prepare a coating dispersion, which was referred to as coating dispersion D-1.

(1) 0.025% by weight 2-methoxyethanol solution of the merocyanine dye (sensitizing dye) represented by the following formula; 10 ml

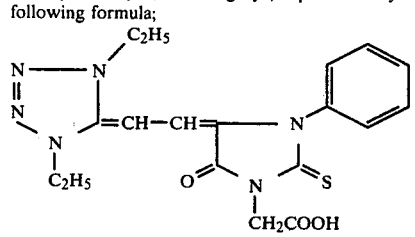

(2) 0.2% by weight methanol solution of sodium benzenethiosulfonate 4 ml
(3) 0.3% by weight methanol solution of benzotriazole 5 ml
(4) 3% by weight methanol solution of phthalazinone (toning agent) 16 ml
(5) 40% by weight acetone solution of the compound (reducing agent) represented by the following formula; 13 ml

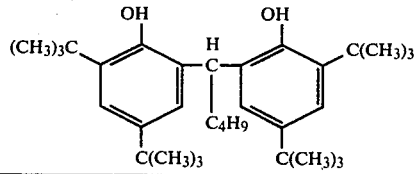

In the same manner as with coating dispersion D-1 except for omitting the addition of benzotriazole, ingredient (3), there was prepared coating dispersion D-2.

In the same manner as with coating dispersion D-1 except for adding 5 ml of a 0.2% by weight methanol solution of mercuric bromide in place of ingredients (2) and (3), there was prepared coating dispersion D-3 in order to prepare Comparative Sample.

Each of these 3 respective coating dispersions D-1 to D-3 was coated on a paper support in an amount of 0.4 g silver/m$^2$ to prepare thermally developable light-sensitive materials identified as Samples D-1 to D-3 respectively.

Each of these samples was exposed through an optical wedge in an amount of 1000 lux.sec and then heated for 8 seconds or 13 seconds at 130° C. to obtain black images. The reflection density of these samples was then measured, and the reciprocal of the exposure amount necessary to provide a reflection density of fog+0.1 was calculated as the basis for sensitivity. In Tables 9 and 10 these are shown the maximum density, heat fog and relative sensitivity (taking the sensitivity of sample D-3 as 100 of the resulting Samples.

TABLE 9

| | 130° C., 8 seconds | | |
|---|---|---|---|
| Sample | Heat Fog | Maximum Density | Relative Sensitivity |
| D-1 | 0.09 | 1.49 | 112 |
| D-2 | 0.10 | 1.50 | 105 |
| D-3 | 0.11 | 1.48 | 100 |

TABLE 10

| | 130° C., 13 seconds | | |
|---|---|---|---|
| Sample | Heat Fog | Maximum Density | Relative Sensitivity |
| D-1 | 0.10 | 1.53 | 112 |
| D-2 | 0.12 | 1.52 | 104 |
| D-3 | 0.13 | 1.51 | 100 |

From these results, it is seen that Sample D-1 containing both benzotriazole and benzenethiosulfonic acid suffered less heat fog as compared with other Samples, thus being excellent. It is also seen that combined use of both of these components provides better results than in the case of using either of them alone.

Then, fresh light-sensitive material Samples identical to the above except not having been subjected to the above-described image-forming processing were placed in a sealed container and left for 24 hours at 50° C. and 80% RH. The samples were then taken out and subjected to the same image-forming processing as described above, followed by sensitometry. The results are shown in Tables 11 and 12, where the standard of relative sensitivity was the same as above.

TABLE 11

| | 130° C., 8 seconds | | |
|---|---|---|---|
| Sample | Heat Fog | Maximum Density | Relative Sensitivity |
| D-1 | 0.08 | 1.45 | 115 |
| D-2 | 0.08 | 1.38 | 70 |
| D-3 | 0.05 | 1.22 | 67 |

TABLE 12

| | 130° C., 13 seconds | | |
|---|---|---|---|
| Sample | Heat Fog | Maximum Density | Relative Sensitivity |
| D-1 | 0.10 | 1.50 | 109 |
| D-2 | 0.14 | 1.42 | 73 |
| D-3 | 0.16 | 1.38 | 72 |

It was observed that the thermally developable light-sensitive material Samples in accordance with the present invention had extremely excellent properties. In particular, the sensitivity thereof did not change from immediately after preparation.

EXAMPLE 6

An aqueous solution prepared by dissolving 0.8 g of cetylethyldimethylammonium bromide in 100 ml of water was mixed with 100 ml of toluene and emulsified. To this emulsion there was added a solution prepared by dissolving 0.425 g of silver nitrate in 10 ml of water to thereby form silver bromide in an emulsified state. To the silver bromide emulsion there was added an emulsion prepared by mixing a solution (prepared by dissolving 12 g of lauric acid in 100 ml of toluene) with a solution (prepared by dissolving 1.9 g of sodium hydroxide in 100 ml of toluene), whereafter a solution prepared by dissolving 8.5 g of silver nitrate in 50 ml of water was added thereto to thereby form silver laurate. There was thus obtained a mixture wherein silver bromide was in intimate contact with silver laurate.

In the above-described process, other oils relatively immiscible with water may be used in place of toluene, and silver bromoiodide, silver chlorobromide or silver chlorobromoiodide may be used in place of silver bromide. Also cetylethyldimethylammoniumbromide may be replaced by another silver halide-forming ingredient and silver laurate may be replaced by silver myristate, silver palmitate or a like silver salt of a fatty acid, or other organic silver salts. Such will be apparent to one skilled in the art.

The mixture was collected by centrifugation and dispersed in 200 g of ethanol (other alcohols, e.g., methanol, n-propyl alcohol, isopropyl alcohol, etc., could be used with success) containing 30 g of a binder (polyvinyl butyral as was used in EXAMPLE 1) using a mixer to prepare a polymer dispersion of the silver salt.

This silver salt polymer solution was maintained at 30° C., and the following ingredients were added in the recited sequence at 5 minute intervals to prepare coating dispersion E-1.

(1) dye

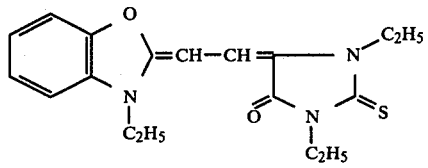

(0.025% methanol solution) 10 ml
(Other merocyanine dyes, cyanine dyes, rhodacyanine dyes, styryl dyes, acidic dyes or the like may similarly be used.)

(2) phthalazone (=phthalazinone, toning agent) 35 ml
(3% by weight methanol solution)
(Phthalimide is similarly effective.)

(3) 2,2-bis(3-methyl-4-hydroxypheny)propane
(20% by weight acetone solution) 25 ml (4) p-methylbenzenethiosulfonic acid sodium salt (0.1% weight methanol solution) 4 ml (5) 1-acetylbenzotriazole (0.3% by weight methanol solution) 5 ml There was then prepared coating dispersion, coating dispersion F-2 (not containing ingredient (5)) following the procedure of EXAMPLE 5.

Each of these respective coating dispersions was coated on a support in an amount of 0.5 g silver/$m^2$ to provide Samples E-1 to E-2, respectively, and these Samples were exposed in the same manner as in EXAMPLE 5 and then heat developed at 140° C. for 8 seconds. The results obtained are shown in Table 13.

TABLE 13

| | 140° C., 8 seconds | | |
|---|---|---|---|
| Sample | Heat Fog | Maximum Density | Relative Sensitivity |
| E-1 | 0.12 | 1.55 | 100 |

TABLE 13-continued

| Sample | Heat Fog | Maximum Density | Relative Sensitivity |
|---|---|---|---|
| | 140° C., 8 seconds | | |
| E-2 | 0.13 | 1.57 | 98 |

Relative sensitivities are shown taking the sensitivity of Sample E-1 as 100.

Identical light-sensitive mateial Samples were stored at 50° C., 80% RH in the same manner as in EXAMPLE 1 prior to exposure and development and were then subjected to the same exposure and development as described above. The results are shown in Table 14.

TABLE 14

| Sample | Heat Fog | Maximum Density | Relative Sensitivity |
|---|---|---|---|
| | 140° C., 8 seconds | | |
| E-1 | 0.14 | 1.52 | 105 |
| E-2 | 0.16 | 1.32 | 58 |

With Sample E-1 containing ingredients (4) and (5) of the present invention, sensitivity was maintained at almost the same or a slightly higher level as compared with that immediately after preparation, and maximum density and heat fog were at the almost same levels as immediately after preparation. Thus, excellent photographic properties were shown. Sample E-2, not containing 1-acetylbenzotriazole, suffered less fog and showed a comparatively high maximum density. However, the sensitivity became about ½ that immediately after preparation.

EXAMPLE 7

3.4 g of behenic acid was dissolved in 100 ml of benzene (at 60° C.) and the solution kept at 60° C. Then, while stirring, 100 ml of water was added thereto and the system emulsified. Subsequently, an aqueous solution (10° C.) prepared by adding aqueous ammonia to about 80 ml of an aqueous solution containing 1.7 g of silver nitrate to form a silver ammine complex salt and making the total amount 100 ml with water was added thereto. The aqueous 28 weight % ammonia was added in an amount sufficient to insure the formation of the complex salt.

There were thus formed fine crystals of silver behenate. Upon standing for 20 minutes, it separated into an aqueous phase and a benzene phase.

The aqueous phase was first removed. Then, 400 ml of fresh water was added thereto to wash by decantation. Then, 400 ml of methanol was added thereto, whereafter silver behenate was collected by centrifugation. There was thus obtained 4 g of spindle-shaped silver behenate about 1 μ in length and about 0.5 μ in width.

When benzene was replaced by tolene, xylene, pentyl acetate, isoamyl acetate, etc., silver behenate was obtained in substantially the same manner.

2.3 g (about 1/200 mol) of the silver behenate thus obtained was dispersed in 20 ml of an ethanol solution containing 2.5 g of polyvinyl butyral as was used in EXAMPLE 1 by ball milling for about 1 hour.

When ethanol was replaced by methanol, propanol or isopropanol, the same results were obtained.

To this silver salt polymer dispersion were added the following ingredients at 50° C. in the recited sequence at 5 minute intervals to prepare a costing dispersion.

| | | |
|---|---|---|
| (1) | Ammonium bromide (silver halide-forming agent) (2.5 % by weight methanol solution) | 1 ml |
| (2) | Sensitizing dye (merocyanine dye represented by the following formula; 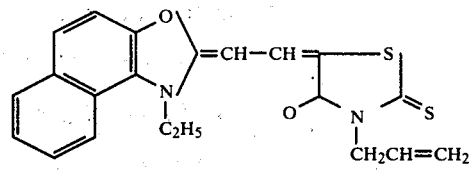 (0.025% by weight 2-methoxyethanol solution) | 1 ml |
| (3) | 2,2'-methylenebis(6-t-butyl-4-methylphenol)(reducing agent)(25% by weight acetone solution) | 3 ml |
| (4) | phthalazone(toning agent)(2.5% by weight 2-methoxyethanol solution) | 3 ml |
| (5) | 4-methylbenzotriazole(0.2 % by weight methanol solution) | 1 ml |
| (6) | potassium 2,4-dimethylbenzenethiosulfonate (0.05% by weight methanol solution) | 2 ml |

When ammonium bromide was replaced by the same molar amount of an inorganic halide such as hydrogen bromide, sodium bromide, potassium bromide, calcium bromide, antimony bromide, etc., almost the same photographic properties resulted. The most favorable dyes were merocyanine dyes containing a rhodanine nucleus, thiohydantoin nucleus, 2-thio-2,4-oxazolizinedione nucleus or pyrazolone nucleus. By adding such a dye, the sensitivity was increased almost 5 fold. The thus prepared coating dispersion was coated on a support (any of art paper, clay coated paper, photographic paper, etc. or a film support such as polyethylene terephthalate) in an amount of 1 g silver/$m^2$ to prepare a thermally developable light-sensitive material (Sample F-1).

In the same manner as in EXAMPLES 5 and 6, thermally developable light-sensitive material Sample F-2, not containing ingredient (6) was prepared. Thermally developable light-sensitive material Sample F-3 was prepared by adding 1 ml of a 0.1% by weight methanol solution of mercuric bromide to a sample prepared in manner identical to Sample F-1except for deleting ingredients (5) and (6).

Photographic properties obtained by exposing and developing in the same manner as in EXAMPLE 5 are shown in Table 15, and the photographic properties after incubation (25 hrs, 50° C., 807° RH) are shown in Table 16.

TABLE 15

| Sample | Heat Fog | Maximum Density | Relative Sensitivity |
|---|---|---|---|
| | 125° C., 15 seconds | | |
| F-1 | 0.11 | 1.52 | 103 |
| F-2 | 0.15 | 1.51 | 97 |
| F-3 | 0.13 | 1.54 | 100 |

Relative sensitivity is given taking the sensitivity of Sample F-3 as 100.

TABLE 16

| Sample | Heat Fog | Maximum Density | Relative Sensitivity |
|---|---|---|---|
| | Exposure and development were conducted after incubation test. (Incubation: 50° C., 80%, 1 day) 125° C., 15 seconds | | |
| F-1 | 0.13 | 1.49 | 105 |
| F-2 | 0.27 | 0.75 | 88 |
| F-3 | 0.15 | 1.25 | 82 |

Relative sensitivity is given taking the sensitivity of F-3 in Table 15 as 100.

In Table 15, Sample F-1 using 4-methylbenzotriazole and potassium 2,4-dimethylbenzenethiosulfonate was not greatly different from other samples in "fresh" photographic properties. However, after incubation, sensitivity was reduced in every sample except for F-1, though heat fog was not so different in Samples F-1 and F-3. From this, it is seen that the thermally developable light-sensitive material of the present invention possessed excellent photographic properties.

EXAMPLE 8

With samples prepared in the same manner as in EXAMPLE 5 except for adding 1-acetyl-5-benzyloxybenzotriazole (compound No. 46) in an equimolar amount in place of benzotriazole and using sodium benzenethiosulfonate, the photographic properties were examined.

In comparing photographic properties immediately after preparation with those after incubation (50° C., 80% RH, 1 day), no change in sensitivity and less heat fog were observed, which effects were not observed when the compounds were used alone. With the sample containing 1-acetyl-5-benzyloxybenzotriazole alone, heat fog increased after incubation and a reduction in sensitivity was observed, while with the sample containing sodium benzenethiosulfonate alone, the reduction in sensitivity was serious, though heat fog was comparatively low, thus providing almost the same results as in Example 5.

EXAMPLE 9

6 g of benzotriazole was dissolved in 100 ml of isoamyl acetate at 50° C. and, while stirring at −15° C., a solution prepared by dissolving 8.5 g of silver nitrate in 100 ml of a dilute nitric acid aqueous solution (adjusted to pH=2.0 at 25° C. with nitric acid) and being adjusted to 30° C. was added thereto. There was thus obtained a dispersion containing fine crystals of benzotriazole silver salt. (When isoamyl acetate was replaced by another oil such as butyl acetate, diethyl sebacate, dibutyl phthalate, tricresyl phosphate, etc., the same results were obtained.) The aqueous phase of the dispersion was then removed and 400 ml of water was added thereto to wash by decantation. Then, 400 ml of methanol was added thereto, and the resulting dispersion centrifuged to collect the silver salt of benzotriazole. There was thus obtained 8 g of benzotriazole silver salt. The particle size of the silver salt particles was about 1 μ in length.

2.5 g of this benzotriazole silver salt was added to 40 ml of a methyl ethyl ketone solution containing 4 g of ethyl cellulose (polyvinyl butyral, polyvinyl acetate, cellulose acetate, cellulose acetate butyrate, etc. are similarly usable) and dispersed therein by ball milling for 1 hour to prepare a silver salt polymer dispersion. The following ingredients were added at 50° C. at 10 minute intervals in the recited order to 45 g of this silver salt polymer dispersion to prepare a coating dispersion. This coating dispersion was coated on a paper support (surface-coated with clay and styrene-butadiene rubber) in an amount of 1 g silver/m$^2$ to prepare thermally developable light-sensitive material Sample G-1.

| | | |
|---|---|---|
| (1) | Cadmium iodide (silver halide-forming ingredient) (8.5% by weight methanol solution) (When other iodides such as zinc iodide, ammonium iodide, hydrogen iodide, strontium iodide, etc. were used, almost the same results were obtained.) | 1.5 ml |
| (2) | 2-methoxyethanol solution containing 2 g of ascorbic acid monopalmitate and 2 g of ascorbic acid dipalmitate (reducing agent) | 10 ml |
| (3) | N-ethyl-N'-dodecylurea (development accelerator) (2.5% by weight 2-methoxyethanol solution) | 2 ml |
| (4) | sensitizing dye 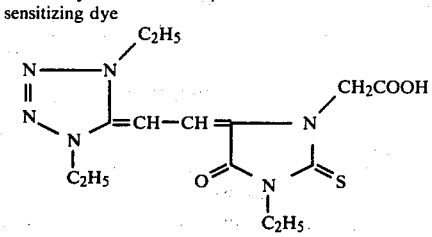 (0.015% by weight 2-methoxyethanol solution) | 2 ml |
| (5) | 1-acetylbenzotriazole (0.1% by weight methanol solution) | 3 ml |
| (6) | sodium p-t-butylbenzenethiosulfonate (0.02% by weight methanol solution) | 4 ml |

For purpose of comparisons, thermally developable light-sensitive material Sample G-2 was prepared in the same manner as described above except for omitting ingredients (5) and (6) and adding 1 ml of mercuric bromide.

The Samples were exposed and developed in the same manner as in Example 5. The results are shown in Table 17. The results obtained by exposing and developing "incubated" Samples as in Example 5 are given in Table 18.

The relative sensitivities are shown as relative values taking the sensitivity of Sample G-2 as 100.

TABLE 17

| Sample | Heat Fog | Maximum Density | Relative Sensitivity |
|---|---|---|---|
| | 135° C., 8 seconds | | |
| G-1 | 0.13 | 1.38 | 102 |
| G-2 | 0.14 | 1.33 | 100 |

TABLE 18

| Sample | Heat Fog | Maximum Density | Relative Sensitivity |
|---|---|---|---|
| | Incubation (50° C.-80%, 1 day) 135° C., 8 seconds | | |
| G-1 | 0.15 | 1.35 | 99 |
| G-2 | 0.18 | 1.30 | 75 |

Sample G-1 containing ingredients (5) and (6) suffered less change in photographic properties after incubation. In particular, sensitivity was almost unchanged. Sample G-2 showed about the same heat fog-preventing effect but suffered reduction of sensitivity after incubation.

While the invention has been described in detail and with reference to specific embodiments thereof, it will be apparent to one skilled in the art that various changes and modifications can be made therein without departing from the spirit and scope thereof.

What is claimed is:

1. A mercury free thermally developable light-sensitive material comprising a support having provided therein or thereon at least one layer containing at least
   (a) a silver salt of a straight chain acid having 10 or more carbon atoms,
   (b) silver halide at least partially formed by the reaction of an N-halo compound, and
   (c) a reducing agent, the support having provided therein or thereon at least one layer containing
   (d) at least one thiosulfonic acid represented by the following general formula $$RSO_2SM$$

wherein R represents a substituted or unsubstituted aliphatic group or a substituted or unsubstituted aryl group and M represents a cation other than hydrogen.

2. The thermally-developable light-sensitive material as claimed in claim 1, wherein R is a substituted or unsubstituted aryl group and M is an alkali or alkaline metal ion.

3. The thermally-developable light-sensitive material as claimed in claim 1, wherein R is an unsubstituted alkyl group having 22 or less carbon atoms, a substituted alkyl group having 30 or less carbon atoms and having from 1 to 4 substituents or an unsubstituted or substituted aryl group having 6 to 30 carbon atoms.

4. The thermally-developable light-sensitive material as claimed in claim 3, wherein R is selected from the group consisting of hexyl, heptyl, ethylhexyl, octyl, nonyl, decyl, dodecyl, hexadecyl, octadecyl, eicosyl, docosyl, cyclohexyl or t-butyl.

5. The thermally-developable light-sensitive material as claimed in claim 3, wherein said substituents are selected from the group consisting of an alkoxy group having 1 to 8 carbon atoms or an aryl group having 6 to 18 carbon atoms.

6. The thermally-developable light-sensitive material as claimed in claim 2, wherein said unsubstituted aryl group is selected from the group consisting of a phenyl group, a naphthyl group or an anthryl group.

7. The thermally-developable light-sensitive material as claimed in claim 2, wherein said substituted aryl group is a phenyl group, a naphthyl group or an anthryl group substituted with a member selected from the group consisting of an alkyl group having 1 to 8 carbon atoms, an alkyl group having 1 to 8 carbon atoms substituted with an aryl group, an aryl group having 6 to 18 carbon atoms, a substituted aryl group, a hydroxy group, a halogen atom, an alkoxy group having 1 to 8 carbon atoms or an acyl group having 1 to 8 carbon atoms.

8. The thermally developable light-sensitive material of claim 1 which further comprises (e) at least one benzotriazole.

9. The thermally developable light-sensitive material as claimed in claim 1 which further comprises at least one carboxylic acid.

10. The thermally developable light-sensitive material claimed in claim 8 which further comprise at least one carboxylic acid.

11. The thermally developable light-sensitive material as claimed in claim 1 which further comprises at least one member selected from the group consisting of a long chain carboxylic acid having more than 12 carbon atoms, rosin or diterpenic acid.

12. The thermally developable light-sensitive material as claimed in claim 8, which further comprises at least one member selected from the group consisting of a long chain carboxylic acid having more than 12 carbon atoms, rosin or diterpenic acid.

13. The thermally developable light-sensitive material as claimed in claim 1 further comprising a lithium carboxylic acid salt.

14. The thermally developable light-sensitive material as claimed in claim 8 further comprising a lithium carboxylic acid salt.

15. The thermally developable light-sensitive material claimed in claim 1, wherein said N-halo compound is represented by one of the two following formulae

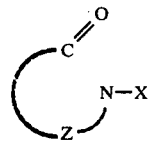
(I)

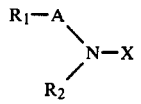
(II)

wherein X is a halogen atom, Z represents the atomic group necessary to form a 5-or 6-membered ring, which can be condensed with another ring, and $R_1$ and $R_2$ each represents a member selected from the group consisting of an alkyl group, an aryl group or an alkoxy group.

16. The thermally developable light-sensitive material claimed in claim 8, wherein said N-halo compound is represented by one of the two following formulae:

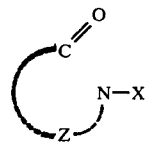
(I)

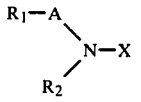
(II)

wherein X is a halogen atom, Z represents the atomic group necessary to form a 5- or 6-membered ring, which can be condensed with another ring, and $R_1$ and $R_2$ each represents a member selected from the group consisting of an alkyl group, an aryl group or an alkoxy group.

17. The thermally developable light-sensitive material as claimed in claim 1, wherein the amount of thiosulfonic acid is about $1\times10^{-5}$ to about 1 mol per 1 mol of the organic silver salt.

18. The thermally developable light-sensitive material as claimed in claim 8, wherein the amount of thiosulfonic acid is from about $1\times10^{-5}$ to about 1 mol per mol of the organic silver salt and the amount of the benzotriazole is from about $1\times10^{-5}$ to about $4\times10^{-1}$ mol per mol of the organic silver salt.

19. The thermally-developable light-sensitive material as claimed in claim 15, wherein said 5- or 6-membered ring is selected from the group consisting of pyrrole, pyrroline, pyrrolidine, imidazole, imidazoline, imidazolidine, pyrazole, pyrazoline, pyrazolidine, triazole, tetrazole, piperidine, oxazine, thiazine, piperazine, hydantoin, cyanuric acid, thiohydantoin, hexahydrotriazine, indole, indoline, isoindole, benzoimidazole, carbazole and phenoxazine, the alkyl and alkoxy groups for $R_1$ and $R_2$ have 1 to about 12 carbon atoms and the aryl group for $R_1$ and $R_2$ is a naphthyl or phenyl group.

20. The thermally-developable light-sensitive material as claimed in claim 16, wherein said 5-or 6-membered ring is selected from the group consisting of pyrrole, pyrroline, pyrrolidine, imidazole, imidazoline, imidazolidine, pyrazole, pyrazoline, pyrazolidine, triazole, tetrazole, piperidine, oxazine, thiazine, piperazine, hydantoin, cyanuric acid, thiohydantoin, hexahydrotriazine, indole, indoline, isoindole, benzoimidazole, carbazole and phenoxazine, the alkyl and alkoxy groups for $R_1$ and $R_2$ have 1 to about 12 carbon atoms and the aryl group for $R_1$ and $R_2$ is a naphthyl or phenyl group.

21. The thermally-developable light-sensitive material as claimed in claim 19, wherein said 5-membered and 6-membered rings are substituted with an alkyl group, an aryl group, an alkoxy group, a halogen atom, an oxygen atom or a sulfur atom.

22. The thermally-developable light-sensitive material as claimed in claim 20, wherein said 5-membered and 6-membered rings are substituted with an alkyl group, an aryl group, an alkoxy group, a halogen atom, an oxygen atom or a sulfur atom.

23. The thermally-developable light-sensitive material as claimed in claim 1, wherein said component (c) is selected from the group consisting of a substituted or unsubstituted bis, tris or tetrakis phenol or a substituted or unsubstituted mono- or bis-naphthol or a di- or polyhydroxynaphthalene.

24. The thermally-developable light-sensitive material as claimed in claim 8, wherein said component (c) is selected from the group consisting of a substituted or unsubstituted bis, tris or tetrakis phenol or a substituted or unsubstituted mono- or bis-naphthol or a di- or polyhydroxynaphthalene.

25. The thermally-developable light-sensitive material as claimed in claim 13, wherein said lithium carboxylic acid salt is a lithium salt of a higher fatty acid selected from the group consisting of lithium myristate, lithium stearate, lithium behenate, lithium palmitate or lithium laurate.

26. The thermally-developable light-sensitive material as claimed in claim 14, wherein said lithium carboxylic acid salt is a lithium salt of a higher fatty acid selected from the group consisting of lithium myristate, lithium stearate, lithium behenate, lithium palmitate or lithium laurate.

27. The thermally-developable light-sensitive material as claimed in claim 8, wherein said component (e) is a benzotriazole of the following general formula:

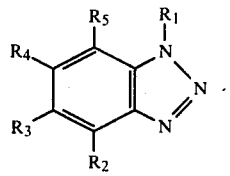

wherein $R_1$ represents a hydroxy group, an alkoxy group, a halogen atom, an acyl group; $R_2$ to $R_5$ each represents an alkyl group, a hydroxy group, an alkoxy group, a benzyloxy group, an acyl group, an acylamido group, a halogen atom or a nitro group.

28. The thermally-developable light-sensitive material as claimed in claim 27, wherein for $R_1$, said alkoxy group has 1 to 8 carbon atoms, said halogen is chlorine or bromine and said acyl group has 1 to 8 carbon atoms and for $R_2$ to $R_5$, said alkyl group has 1 to 12 carbon atoms, said alkoxy group has 1 to 12 carbon atoms, said acyl group has 1 to 8 carbon atoms, said acylamido group is of the formula NHCOR6 where $R_6$ is an alkyl group having 1 to 12 carbon atoms or a phenyl group and said halogen atom is chlorine, bromine or iodine.

29. The thermally-developable light-sensitive material as claimed in claim 1, wherein said component (d) is selected from the group consisting of sodium n-octylthiosulfonate, potassium n-dodecylthiosulfonate, potassium n-dodecanethio-sulfonate, sodium benzylthiosulfonate, sodium n-undecanethio-sulfonate, potassium n-tetradecanethiosulfonate, lithium benzylthiosulfonate, potassium n-hexadecanethiosulfonate, potassium 2-ethoxyethylthiosulfonate, sodium benzenethiosulfonate, lithium benzenethiosulfonate, potassium benzenethiosulfonate, sodium p-toluenethiosulfonate, potassium p-methoxy-benzenethiosulfonate, potassium p-ethoxybenzenethiosulfonate, sodium 2-naphthylthiosulfonate, potassium 3-t-butylbenzene-thiosulfonate, sodium 3,4-dimethylbenzenethiosulfonate, potassium 3-chlorobenzenethiosulfonate, sodium 4-nitrobenzenethio-sulfonate and potassium 3-acetylbenzenethiosulfonate.

30. The thermally-developable light-sensitive material as claimed in 1, wherein component (d) included a 2-thiouracil represented by the formula

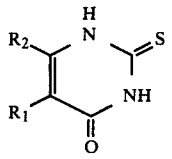

wherein $R_1$ represents a hydrogen atom, a hydroxy group, an alkoxy group, a halogen atom, a substitute lower alkyl group or an unsubstituted alkyl group, a benzyl group, an allyl group, an amino group, a nitro group or a nitroso group, and $R_2$ represents a hydrogen atom, a hydroxy group, a halogen atom, an amino group, an acetoamido group, a substituted or unsubstituted alkyl group having 1 to 22 carbon atoms, an aryl group or a substituted aryl group.

31. The thermally-developable light-sensitive material as claimed in claim 1, wherein said component (d) is the essential heat antifoggant in the light-sensitive material.

* * * * *